US005150890A

United States Patent [19]

Kunikawa et al.

[11] Patent Number: 5,150,890

[45] Date of Patent: Sep. 29, 1992

[54] FEEDING DEVICE FOR ENABLING CONTINUOUS COPY PAPER FEED FROM PLURAL COPY PAPER CASSETTES

[75] Inventors: Norihide Kunikawa, Yao; Yoshikado Yamada, Kashihara; Yoshiteru Mori, Nara; Toshihisa Matsuo, Yamatokoriyama, all of Japan

[73] Assignee: Sharp Kabushiki Kaisha, Osaka, Japan

[21] Appl. No.: 518,466

[22] Filed: May 3, 1990

[30] Foreign Application Priority Data

May 15, 1989 [JP] Japan ..... 1-121806

[51] Int. Cl.[5] ..... B65H 3/44

[52] U.S. Cl. ..... 271/9; 271/127; 271/265; 271/147; 271/162

[58] Field of Search ..... 271/9, 127, 152, 154, 271/157, 155, 160, 162, 164, 171, 145, 147, 241, 253-255, 265

[56] References Cited

U.S. PATENT DOCUMENTS 4,577,849 3/1986 Watanabe .
4,763,889 8/1988 Dei et al. ..... 271/9
4,790,524 12/1988 Murakami et al. .

FOREIGN PATENT DOCUMENTS 3317910 5/1983 Fed. Rep. of Germany .
3825937 7/1988 Fed. Rep. of Germany .
56-59245 5/1981 Japan .
59-123859 7/1984 Japan .
262735 12/1985 Japan ..... 271/145
87431 3/1989 Japan ..... 271/145
639346 5/1979 Switzerland .
2022059 12/1979 United Kingdom .
2066791 7/1981 United Kingdom .

*Primary Examiner*—Robert P. Olszewski
*Assistant Examiner*—Boris Milef
*Attorney, Agent, or Firm*—Birch, Stewart, Kolasch & Birch

[57] ABSTRACT

A feeding device for enabling continuous copy paper feed from a first and second cassette. When copy material of the same size is stored in a first cassette and an absence of copy material is detected in the first cassette, orientation of the second rotatable cassette is altered, if necessary to coincide with that of the first cassette, and paper feed continues from the second rotatable cassette. Still further, the second rotatable cassette may be selected for continuing copy paper feed if copy material within the first cassette is detected to be less than a predetermined amount.

25 Claims, 16 Drawing Sheets

FIG. 9 (c)(1)
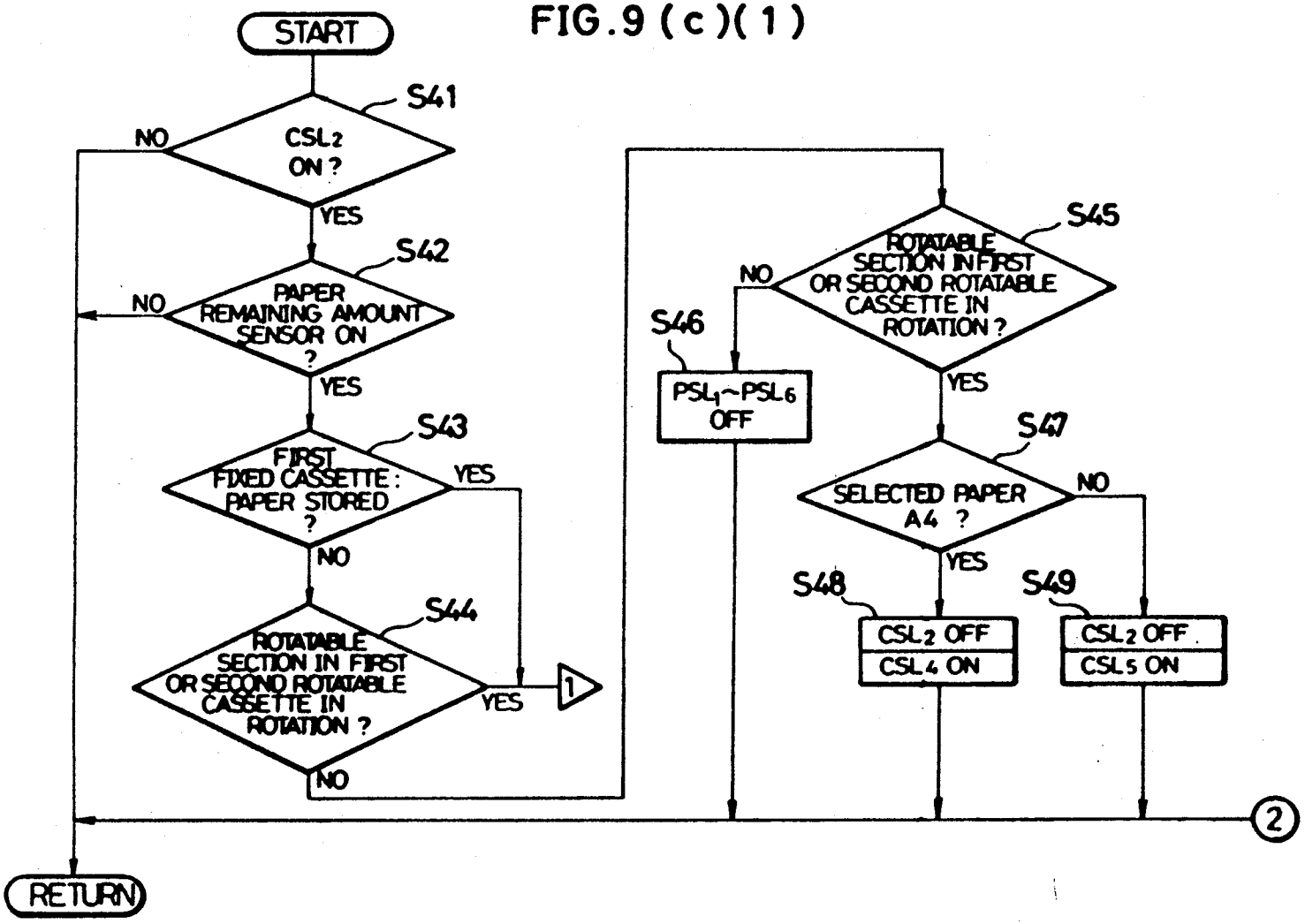

FIG. 9(c)(2)
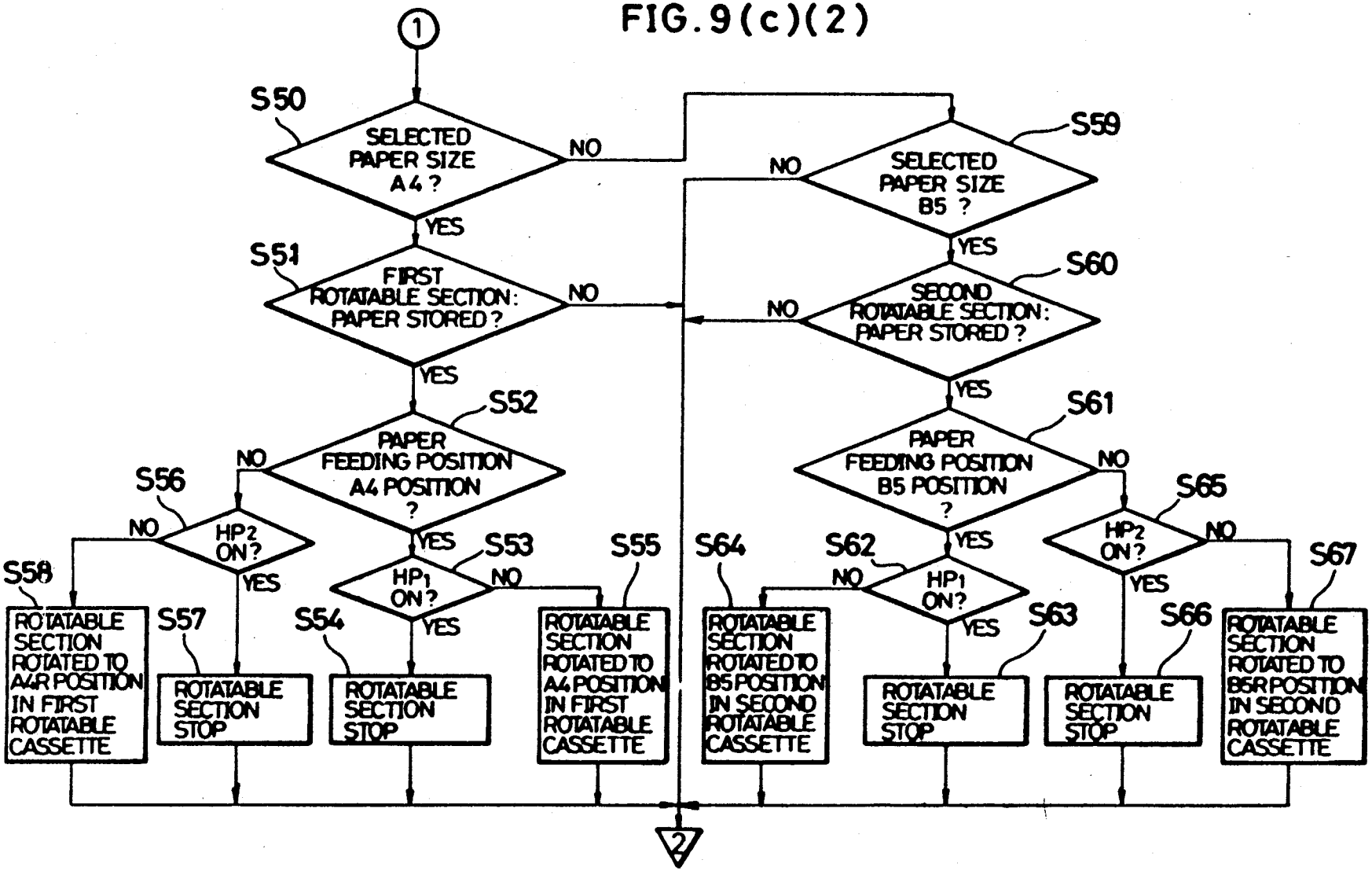

FEEDING DEVICE FOR ENABLING CONTINUOUS COPY PAPER FEED FROM PLURAL COPY PAPER CASSETTES

FIELD OF THE INVENTION

The present invention relates to a feeding device for use in copying machines, printers, over-head projectors and other apparatuses.

BACKGROUND OF THE INVENTION

Conventionally, for example in a copying machine, there is installed a paper feeding device for feeding copy paper which is provided with a plurality of paper feed cassettes classified by each size of copy paper. For conveying the copy paper from the paper feeding device, lateral feed where the transport direction coincides with the crosswise direction of the copy paper, is preferred in terms of transport speed to longitudinal feed where the transport direction coincides with the lengthwise direction of the copy paper, and therefore in some of the copying machines, even large size copy paper such as size B4 or A3 is fed thereto by lateral feed.

However, feeding large sized copy paper laterally causes the photosensitive drum, the transport rollers, the transport paths of the copy paper, and other parts inside the copying machine to become large. As a result, the copying machine itself becomes large and bulky, and its cost rises. Hence generally, the method of longitudinally feeding copy paper of a large size such as A3 or B4, and laterally feeding copy paper of a size not larger than A4, is adopted.

However, with such an arrangement, in a copying machine with a variable magnification function that performs reductions and enlargements, for instance B5R and A4R, paper feeding cassettes that feed the copy paper longitudinally are necessary to perform reduced copies. In addition, when thinking of transport speed, A4 and B5 paper feeding cassettes that feed the copy paper laterally, are also necessary. Accordingly, when it comes to installing those different types of paper feeding cassettes, either the paper feeding device has to be designed in a large size, or the paper feeding cassettes must be changed as occasion calls. This causes the size of the copying machine to be large and its cost to rise, or the operation of the copying machine becomes complicated.

Therefore, copying machines designed to solve the above problems have been disclosed in Japanese Patent Publication (laid-open) No. 59245/1981 and No. 123859/1984 (Tokukaisho 56-59245 and 59-123859), wherein the same paper feeding cassette is commonly used, for example, for both B5 and B5R copy paper or for A4 and A4R copy paper, and by rotating the feeding position of copy paper in the paper feeding cassette, the arrangement permits the copy paper to be shifted to either a lateral or longitudinal feeding position.

In the conventional apparatus of this type, when copy paper in a cassette has been consumed during its feeding operation of, for example, A4 copy paper, it is necessary to stop the copying operation for a while and then, if there are any other paper feeding cassettes available to feed A4 copy paper, it is necessary to start the operation again after having switched the paper feeding cassette to one of those cassettes available.

However, in the conventional arrangement, in order to start the copying operation again when the copy paper has been consumed, before turning on the print switch again, the operator has to perform operations such as; supply copy paper, select a proper paper feeding cassette if there are any fixed or rotatable cassettes storing copy paper of the same size in the same feeding position, or rotate copy paper in a rotatable cassette so as to be set in the same feeding position by operating a rotation key if there are any rotatable cassettes storing copy paper of the same size but set in a different feeding position. Accordingly, the arrangement presents problems in that it is difficult to obtain an efficient operability, and as a result, time required for the copying machine to convey a given amount of copy paper tends to increase.

SUMMARY OF THE INVENTION

It is an object of the present invention to control a cassette storing copy material of the same size so as to set the copy material therein in the same longitudinal or lateral feeding position as copy material in a cassette for the current feeding operation, and to automatically supply desired copy material successively when the copy material for the current feed has been consumed or contains less than a predetermined amount thereof in the cassette storing the copy paper for the current feed.

In order to achieve the above object, a feeding device according to the present invention comprises: copy material existence detection means for detecting the existence or nonexistence of copy material selected for the current feeding operation and placed on a copy material feed unit for holding the copy material; copy material orientation changing means capable of shifting the copy material to two feeding positions at least; and control means for controlling the feeding position directed by the copy material orientation changing means. With the arrangement, when copy material of the same size as that in the copy material feed unit is stored in the copy material orientation changing means and the nonexistence of the copy material in the copy material feed unit is detected by the copy material existence detection means, the copy material orientation changing means is controlled by the control means so as to be set in the same feeding position as the copy material feed unit.

For example, when copy material of size A4 for the current feed stored in a copy material feed unit has been consumed, if at least one copy material orientation changing means stores copy material of size A4, it is shifted to the same feeding position. Accordingly, when the copy material for the current feed has been consumed, it is possible to perform the next feed of copy material of the same size automatically. In addition, the copy material feed unit may be a fixed type, or of movable type in its feeding position.

Besides the above arrangement, another feeding device according to the present invention comprises a copy material remaining amount detection means for detecting a remaining amount of copy material stored in the copy material feed unit. With this arrangement, when copy material of the same size as that in the copy material feed unit is stored in the copy material orientation changing means, and when it is detected by the copy material remaining amount detection means that a remaining amount of copy material in the copy material feed unit is less than a predetermined amount, the copy material orientation changing means is shifted by the control means so as to set the copy material therein in the same feeding position as the copy material for the current feed in the copy material feed unit.

For example, when a remaining amount of copy material of size A4 stored in the copy material feed unit contains less than a predetermined amount, if at least one copy material orientation changing means stores copy material of size A4, it is shifted so as to have the same feeding position. Accordingly, when the copy material in the copy material feed unit has been consumed, it is possible to perform successive feeding of copy material automatically without the waiting time required in shifting the copy material orientation changing means. In addition, the predetermined amount may be preset based on an amount by which the copy material feed unit for the current feed is able to continue its feeding operation until the shifting of the copy material orientation changing means is completed after it has been detected by the copy material remaining amount detection means that a remaining amount of copy material for the current feed contains less than the predetermined amount. This arrangement makes the successive feeding of copy material more reliable.

For a fuller understanding of the nature and advantages of the invention, reference should be made to the ensuing detailed description taken in conjunction with the accompanying drawings.

BRIEF DESCRIPTION OF THE DRAWINGS

FIG. 1(*a*) is a flow chart showing a schematic arrangement of the main program of a copying machine;

FIG. 1(*b*) is a flow chart showing a subroutine of S5 in FIG. 1(*a*);

FIG. 1(*c*) is a flow chart showing a subroutine of S6 in FIG. 1(*a*);

FIG. 2 is a diagram showing the whole structure of a copying machine comprising a paper feeding device;

FIG. 3 is a perspective view showing a part of the copying machine shown in FIG. 2 wherein a second rotatable cassette is drawn out;

FIG. 4(*a*) is a partial sectional perspective illustration showing the structure of a first and the second rotatable cassettes shown in FIG. 2;

FIG. 4(*b*) is an enlarged perspective view showing a nut member shown in FIG. 4(*a*) and the periphery thereof.;

FIG. 5 is a perspective view showing projecting members disposed in each fixed cassette and in a cassette mounting unit of a main body and a desk part;

FIG. 6(*a*) is a front view of an operation panel;

FIG. 6(*b*) is a front view of a cassette operation unit of the operation panel;

FIG. 7 is a block diagram showing the structure of a control device;

FIG. 8 is an explanatory diagram showing the rotating process of a rotatable section in the rotatable cassette.

FIG. 9(*a*) is a flow chart showing a schematic arrangement of the main program of a copying machine;

FIG. 9(*b*) is a flow chart showing a subroutine of S5 in FIG. 9(*a*);

FIG. 9(*c*)(1).(2) are flow charts showing a subroutine of S6 in FIG. 9(*a*);

FIG. 10(*a*) is a schematic vertical sectional front view of a first fixed cassette;

FIG. 10(*b*) is a schematic vertical sectional side view of the first fixed cassette;

FIG. 11 is a block diagram showing the structure of a control device.

DESCRIPTION OF THE PREFERRED EMBODIMENTS

The following description will discuss one embodiment of the present invention referring to FIGS. 1 through 8.

Figure 2:
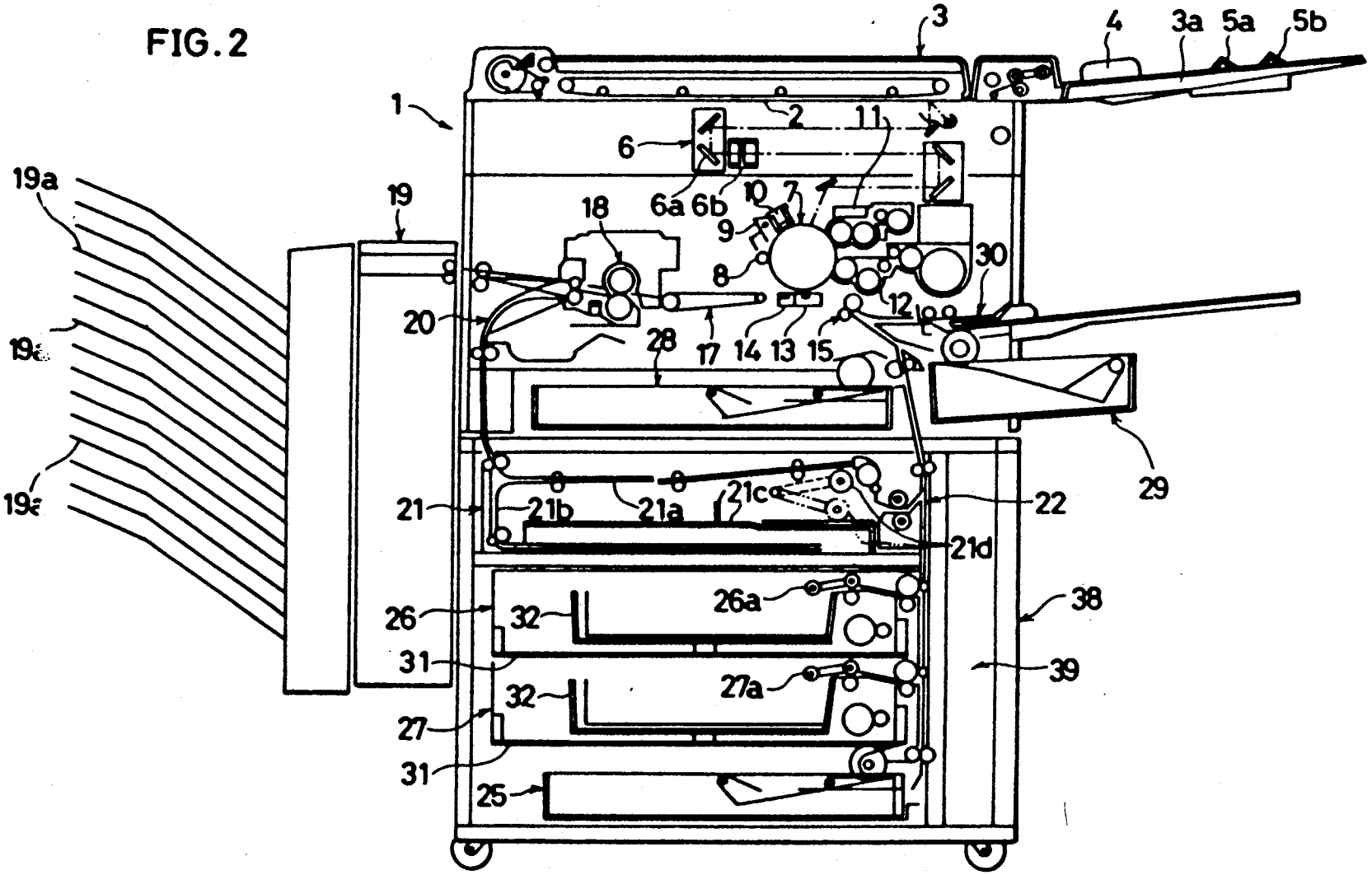
Figure 3:
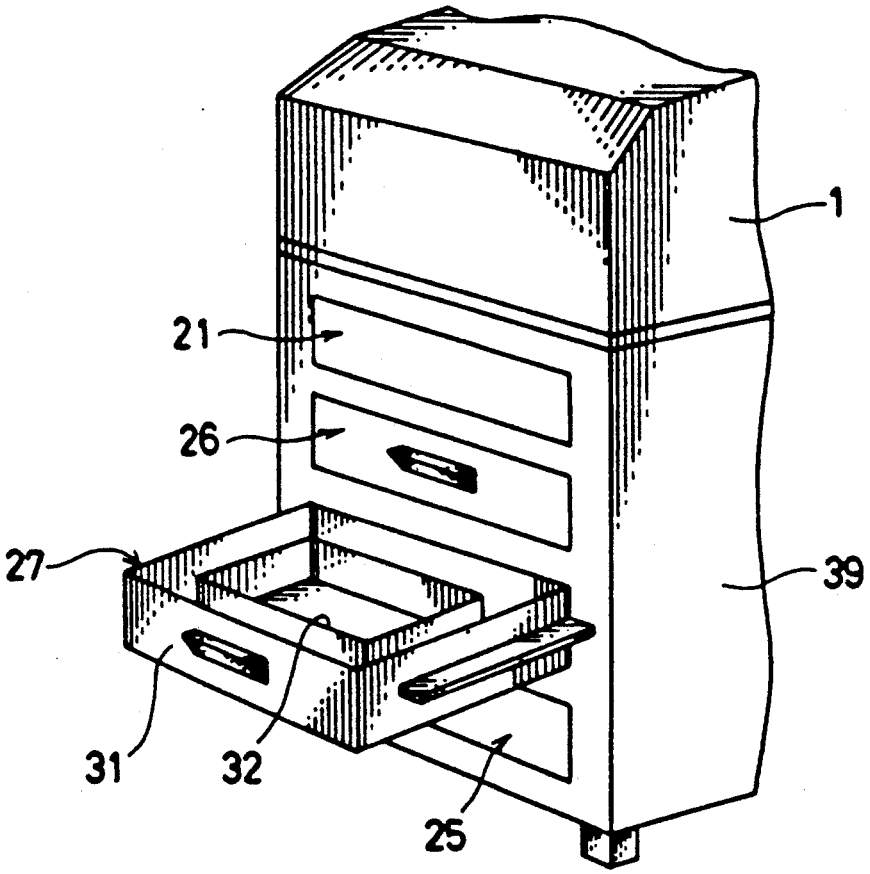

As shown in FIG. 2, a copying machine comprises a desk part 38 under a copying machine main body 1, a sorter 19 at the paper discharging side of the copying machine main body 1, and an automatic document feeder 3 (hereinafter called ADF) on the copying machine main body 1. In the desk part 38, as shown in FIG. 3, there are installed a duplex/composite unit 21, a first rotatable cassette 26, a second rotatable cassette 27, and a third fixed cassette 25 in a descending order from the top. The first and second rotatable cassettes 26, 27 respectively comprise a rotatable section 32 (copy material orientation changing means) disposed in an outer box 31 (housing member).

The ADF 3 is installed on a document glass plate 2 of the copying machine main body 1. The ADF 3 comprises functions for feeding documents (not shown) placed on a document placing tray 3*a* to a predetermined position on the document glass plate 2 one by one according to the size and the longitudinal or lateral feeding position thereof and for discharging the document outside after the copying operation has been completed. Furthermore, for example in order to perform a duplex copying operation, it also comprises a function for turning over the document and conveying it to a predetermined position on the document glass plate 2 again and for discharging it outside after the duplex copying operation has been completed.

On the document placing tray 3*a*, there are installed feeding position detection switches 5*a*, 5*b* for detecting the size of a document in its feeding position and a guide 4 for guiding both sides of the document in its crosswise direction. On the guide 4, there are secured crosswise direction detection switches (not shown) for detecting the size of the document in its crosswise direction.

Under the document glass plate 2, there is disposed an optical system 6 comprising a plurality of reflecting mirrors 6*a* and lenses 6*b*. In addition to a basic function for leading an optical image of a document onto a photosensitive drum 7, the optical system 6 is designed to have a variable magnification function which permits not only full-size copying but also enlargement and reduction copying.

Around the photosensitive drum 7, there are disposed a cleaner 8, a charge eliminator 9, a main charger 10, a developing device !I for storing toner for color copying and a developing device 12 for storing black toner, and by the use of these means as well as the optical system 6, a sequence of operations with respect to the photosensitive drum 7, charging, exposure, developing, elimination of remaining toner and charge elimination is executed.

Under the photosensitive drum 7, are disposed a transfer charger 13 and a separating charger 14, and by the transfer charger 13, a toner image on the photosensitive drum 7 is transferred onto a copy paper (copy material) which has been supplied onto the photosensitive drum 7, and then the copy paper is separated from the photosensitive drum 7 by the separating charger 14.

The copy paper is conveyed to a fixing device 18 by a conveyer belt 17, and then the toner image thereon is fixed by the fixing device 18 by applying heat and pressure.

Having passed through the fixing device 18, the copy paper is discharged onto the predetermined one of copy receiving trays 19*a* by way of sorter 19 in the normal course of operation. However, in the case of performing duplex copying or composite copying, the copy paper is led to a duplex/composite unit 21 in the desk part 38 after having passed through a paper returning path 20.

More specifically, in the case of duplex copying, the copy paper is placed on an intermediate tray 21*c* with its sides turned over after having passed through a first conveying path 21*a* in the duplex/composite unit 21, and then is sent to a paper feeding path 22 by a delivery roller 21*d*. On the other hand, in the case of composite copying, the copy paper is conveyed to a second paper conveying path 21*b* in the duplex/composite unit 21, where the copy paper is conveyed reversely when the rear edge of the copy paper has been detected. The copy paper is then placed on the intermediate tray 21*c* with its sides turned over after having passed through the first conveying path 21*a*, and is sent to the paper feeding path 22 by a delivery roller 21*d*.

The paper feeding path 22 is elongated to the vicinity of the photosensitive drum 7, and at the end thereof there is disposed a paper stopping roller 15 for synchronizing the delivery of the copy paper to the rotation of the photosensitive drum 7. Moreover, a plurality of paper feeding means are connected to the paper feeding path 22 so as to optionally supply copy paper therefrom.

More concretely, as the paper feeding means there are installed: a manual paper feeding unit 30; a first fixed cassette 29 (copy material feed unit) capable of storing 500 sheets of copy paper; a second fixed cassette 28 (copy material feed unit) capable of storing 250 sheets of copy paper; the duplex/composite unit 21; the first rotatable cassette 26; the second rotatable cassette 27; and a third fixed cassette 25 (copy material feed unit) capable of storing 250 sheets of copy paper, where these means are shown in the order of having a shorter paper feeding path for feeding copy paper to the paper stopping roller 15 in the copying paper main body 1. The first and second fixed cassettes 29, 28 located in the copying machine main body 1, the duplex/composite unit 21, the first and second rotatable cassettes 26, 27, and the third fixed cassette 25 located in the desk part 38 form a cassette group of a paper feeding device 39 (feeding device). Each of the fixed cassettes 29, 28, 25 and the rotatable cassettes 26, 27 is removably placed in the copying machine.

Figure 4A:
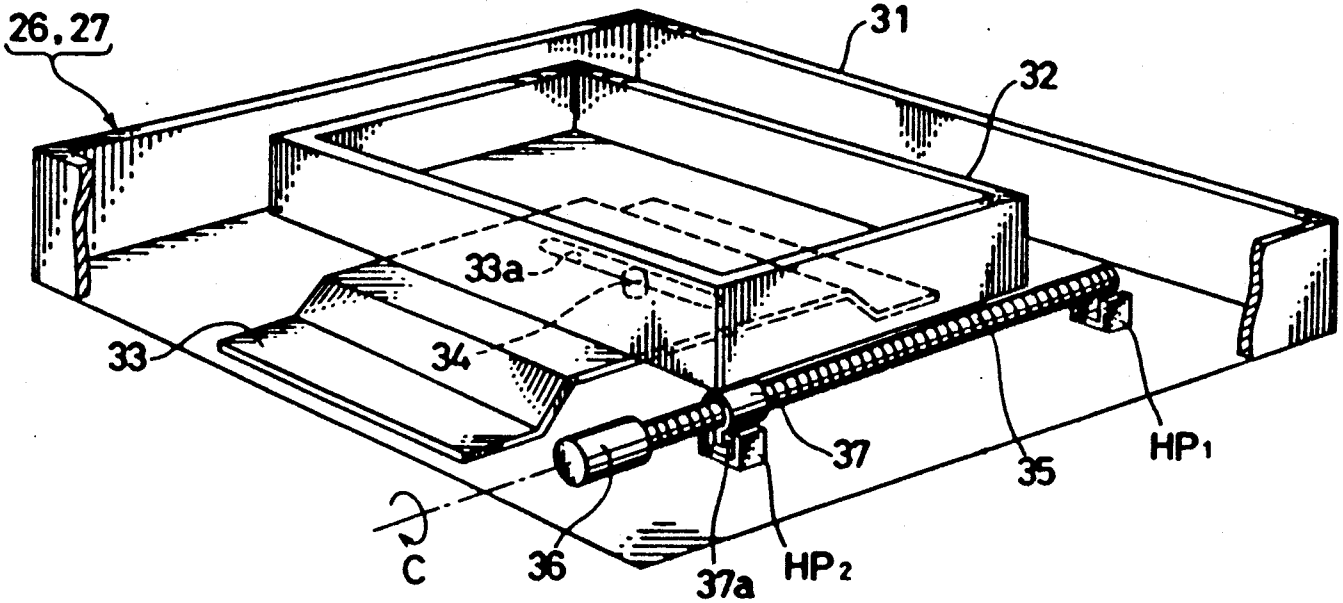
Figure 4B:
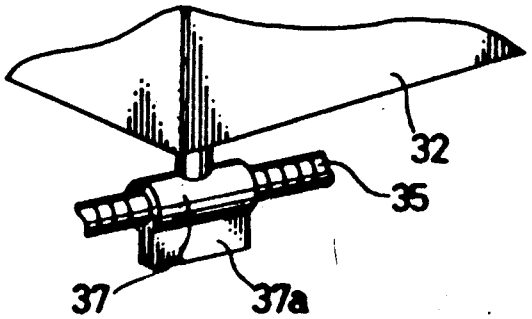

As shown in FIG. 4(*a*), the first and second rotatable cassettes 26, 27 are installed in respective outer boxes 31, and respectively comprise a rotatable section 32 (copy material orientation changing means) for storing copy paper of a predetermined size. The rotatable section 32 comprises a pivotal copy material holding plate (not shown) for properly lifting up copy paper in the rotatable section 32 according to the reduction thereof. On the bottom of the outer box 31, is installed a rotatable section support plate 33 (supporting member) having a space to the bottom wall of the outer box 31 at the center part thereof. The rotatable section support plate 33 comprises a guiding hole 33*a* in the center thereof which has an elongated shape in the feeding direction of copy paper. In the center of the backside of the rotatable section 32, is secured a guiding shaft 34 (guiding member) protruding downward to be disposed within the guiding hole 33*a*.

Moreover, in the outer box 31, is installed a threaded shaft 35 at right angles with the feeding direction of the rotatable section 32 and parallel to the bottom wall of the outer box 31. The threaded shaft 35 is rotatably supported by bearings (not shown), and is coupled with a shaft of a driving motor 36 (driving means) at one end thereof, thereby being permitted to rotate either clockwise or counterclockwise. The clockwise rotation is indicated by C in FIG. 4(*a*). The threaded shaft 35 is adapted to engage a nut member 37 capable of making reciprocating movements along the threaded shaft 35 according to the clockwise or counterclockwise rotation of the threaded shaft 35. As shown in FIG. 4(*b*), the nut member 37 is rotatably connected to one corner of the rotatable section 32 at the upper end thereof. The nut member 37 further comprises a light interrupting part 37*a* at the lower part thereof.

On the other hand, below the vicinity of both ends of the threaded shaft 35 on the bottom wall of the outer box 31, there are installed a lateral position sensor $HP_1$ (position detection means) comprising a photointerrupter having a light emitting element and a light receiving element for detecting a state that the rotatable section 32 has been rotated to be set in a predetermined lateral feeding position, and a longitudinal positon sensor $HP_2$ (position detection means) for detecting a state that it has been set in a predetermined longitudinal feeding position. Both of these position sensors $HP_1$, $HP_2$ are designed to detect where the rotatable section 32 is positioned by the use of the fact that light being emitted from the light emitting element to the light receiving element is interrupted by the light interrupting part 37*a* when the rotatable section 32 is moved to a predetermined lateral or longitudinal feeding position. (At this time, an output of the position sensor $HP_1$ or $HP_2$ whose light reception is interrupted is switched on.) In addition, the lateral and longitudinal position sensors $HP_1$ and $HP_2$ are not limited to photointerrupters, but may be, for example, magnetic sensors, contact switches, or other devices.

Figure 5:
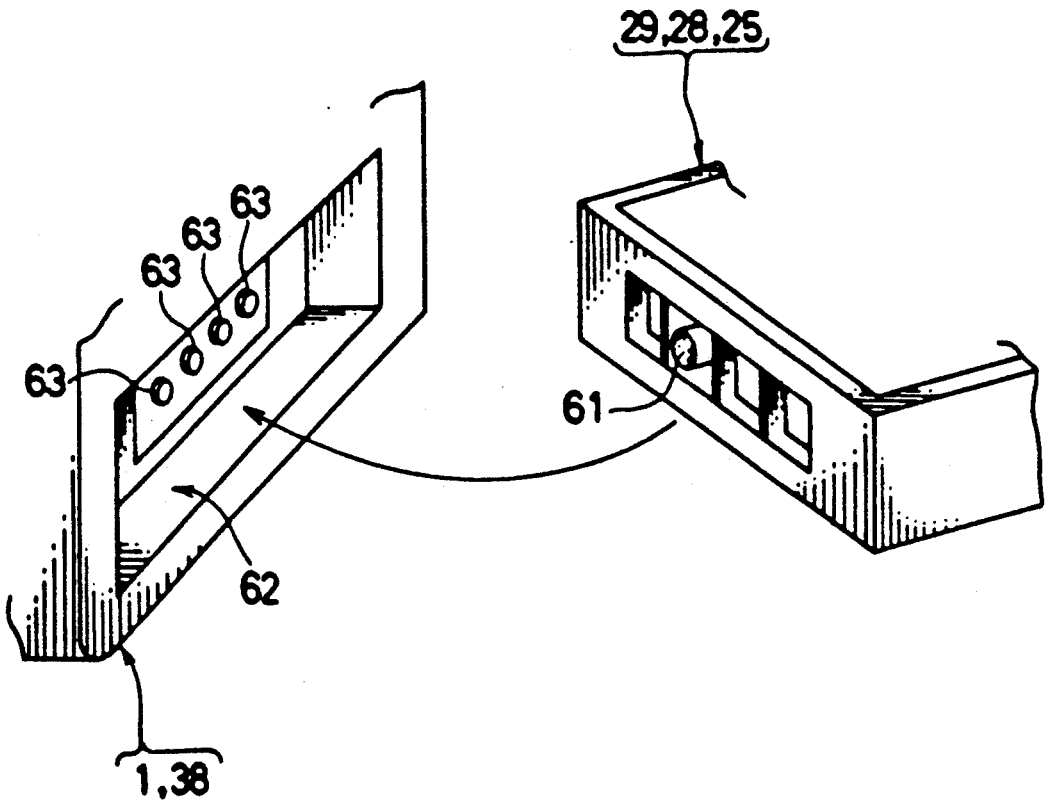

Moreover, the first fixed cassette 29 and the second fixed cassette 28 in the copying machine main body 1 and the third fixed cassette 25 in the desk part 38 respectively comprise a projecting member 61, as shown in FIG. 5. The projecting member 61 is fixed to a predetermined position indicating the size of copy paper stored in each of the fixed cassettes 29, 28, 25. On the other hand, on cassette mounting units 62 in the copying machine main body 1 and in the desk part 38, are installed a plurality of paper size detection switches 63 one of which is switched on by the projecting member 61. In the present embodiment, four paper size detection switches 63 are installed which respectively correspond to copy paper sizes, for example, A3, B4, A4 and B5. Each of the paper size detection switches 63 is connected to a microcomputer 51 as a control means, which will be described later, and this arrangement permits the microcomputer 51 to recognize the size and feeding position of copy paper stored in each of the fixed cassettes 29, 28, 25. On the other hand, the size of copy paper stored in each of the rotatable sections 32 in the first and second rotatable cassettes 26, 27 is entered into the microcomputer 51 by the same arrangement or by other input means.

Figure 6:
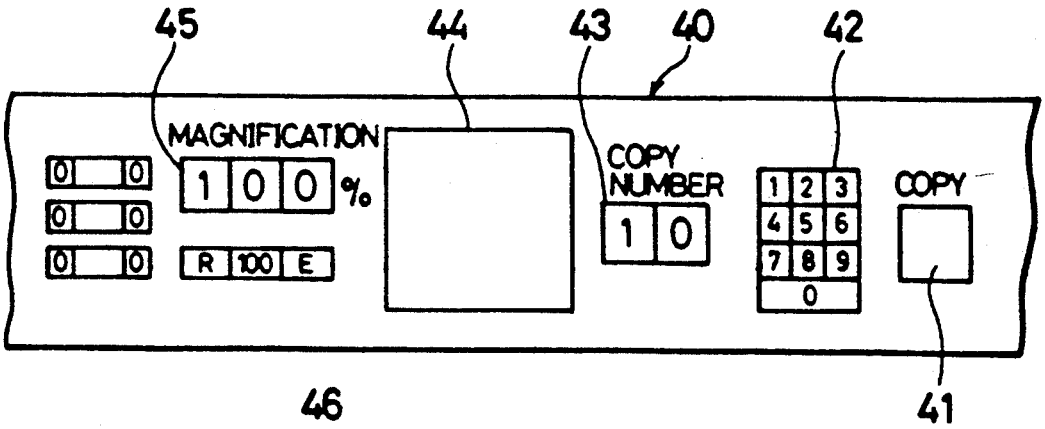
Figure 6:
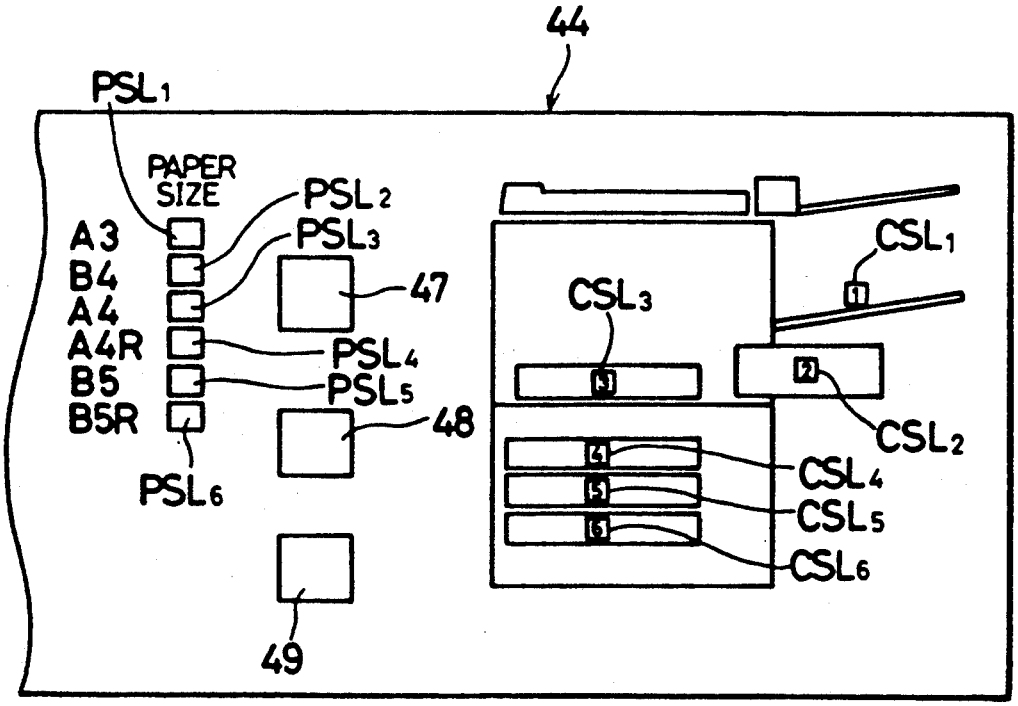

Furthermore, the copying machine main body 1 comprises an operation panel 40 on the top surface thereof as shown in FIG. 6(*a*). The operation panel 40 comprises a copy button 41 for instructing the start of a copying operation, ten keys 42 for setting the number of copies or the like, a copy number display 43, a cassette operation unit 44, a magnification display 45, and magnification setting keys 46 and other units.

As shown in FIG. 6(*b*), the cassette operation unit 44 comprises a cassette changeover key 47 for selecting cassettes, a rotation key 48 for instructing the rotation of the rotatable section 32 in the first rotatable cassette 26, and a cassette rotation key 49 for instructing the rotation of the rotatable section 32 in the second rotatable cassette 27. The cassette operation unit 44 further comprises paper size display lamps $PSL_1$ through $PSL_6$ for giving information concerning copy paper (size and feeding position thereof) selected for a feeding operation, and cassette selection display lamps $CSL_1$ through $CSL_6$ for displaying the paper feeding means by the use of numbers 1 through 6, each of which, in due order, corresponds to the manual paper feeding unit 30, the first fixed cassette 29, the second fixed cassette 28, the first rotatable cassette 26, the second rotatable cassette 27, and the third fixed cassette 25.

The cassette selection display lamps $CSL_1$ through $CSL_6$ are designed to be lighted respectively when one of the rotatable cassettes 26, 27, the fixed cassettes 25, 28, 29 and the manual paper feeding unit 30 is selected by the cassette changeover key 47, or by the control of the microcomputer 51. For example, when the first rotatable cassette 26 is selected by the operation of the cassette changeover key 47, the cassette selection display lamp $CSL_4$ is illuminated, and in the case where copy paper of size A4 is stored in the rotatable section 32 in the first rotatable cassette 26, the paper size display lamp $PSL_3$ is illuminated, thereby indicating that the copy paper is in A4 feeding position. In this case, when the rotation key 48 is operated, the rotatable section 32 is rotated from its lateral feeding position to its longitudinal feeding position, and the paper size display lamp $PLS_3$ is extinguished, and then the paper size display lamp $PLS_4$ is illuminated to indicate that the copy paper is in an A4R feeding position. In addition, when there is no copy paper stored or supplied in any of the rotatable cassette 26, 27, the fixed cassettes 25, 28, 29 or the manual paper feeding unit 30, none of the paper size display lamps $PSL_1$ through $PSL_6$ are illuminated.

Figure 7:
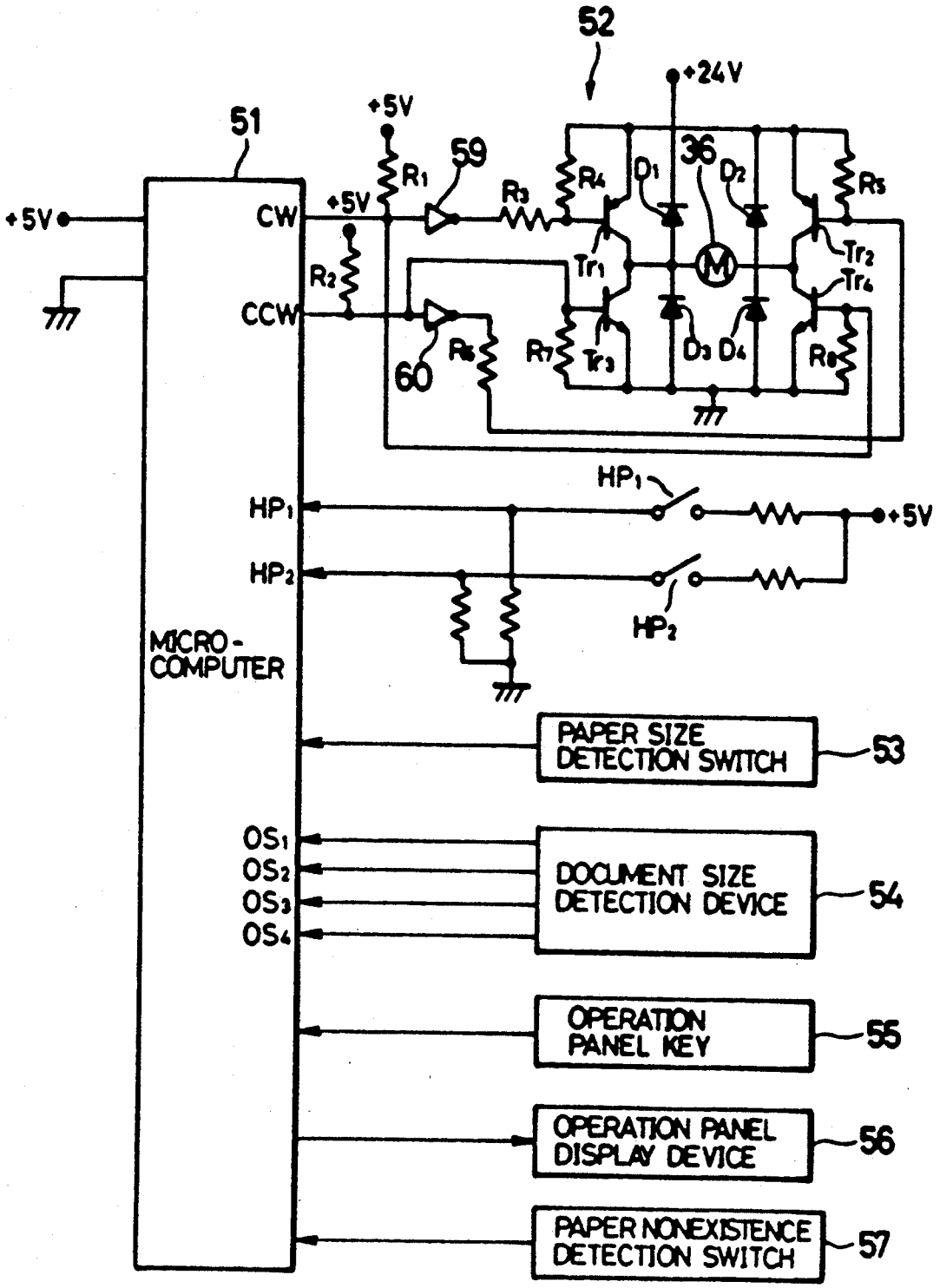
Figure 8:
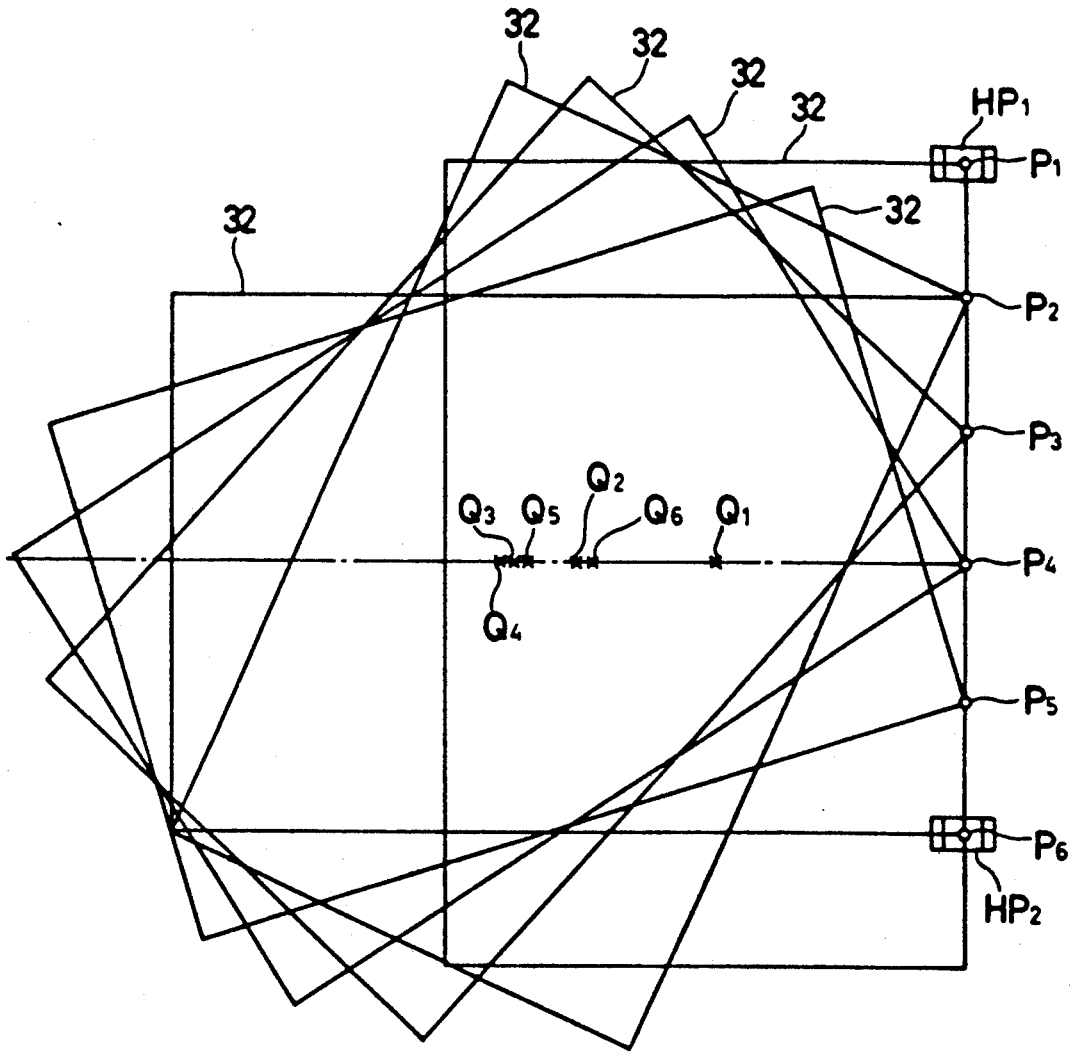

Moreover, as shown in FIG. 7, the copying machine comprises a microcomputer 51 as a control means. To the microcomputer 51, there are connected a motor driver circuit 52, the lateral and longitudinal position sensors HP1, HP2, a paper size detection switch 53, a document size detection switch 54, an operation panel key 55, an operation panel display 56, a paper nonexistence detection switch 57 as a copy material existence detection means and other devices. The paper feeding device 39 comprises the first to third fixed cassettes 29, 28, 25, the duplex/composite unit 21, the first and second rotatable cassettes 26, 27, means 26*a*, 27*a* for taking out copy paper from the above cassettes or unit and conveying it, the microcomputer 51, each means connected to the microcomputer 51, and other means.

The motor driver circuit 52 and the driving motor 36 are installed in each of the first rotatable cassette 26 and the second rotatable cassette 27 independently. The motor driver circuit 52 comprises pull-up resistors $R_1$, $R_2$, NOT circuits 59, 60, transistors $Tr_1$ to $Tr_4$, resistors $R_3$ through $R_8$, and diodes $D_1$ through $D_4$ as surge suppressors, and drives the driving motor 36 to rotate either clockwise or counterclockwise in response to the output of the microcomputer 51. The pull-up resistor $R_1$, the input of the NOT circuit 59 and the base of the transistor $Tr_4$ are connected to an output terminal CW of the microcomputer 51, and the output of the NOT circuit 59 is connected to the base of the transistor $Tr_1$ through the resistor $R_3$. One end of the resistor $R_4$ is connected to the base of the transistor $Tr_1$, and one end of resistor $R_5$ is connected to the base of the transistor $Tr_2$. The other ends of the resistors $R_4$ and $R_5$ are respectively connected to the emitters of the transistors $Tr_1$ and $Tr_2$, and are also respectively connected to the cathodes of the diodes $D_1$ and $D_2$. The connecting point of these ends is connected to the plus terminal of a DC power source, and a voltage of +24 V is applied thereto. Moreover, the collector of the transistor $Tr_1$ and the anode of the diode $D_1$ are connected to one of the input terminals of the driving motor 36, and the collector of the transistor $Tr_2$ and the anode of the diode $D_2$ are connected to the other of the input terminals of the driving motor 36. On the other hand, the pull-up resistor $R_2$, the input of the NOT circuit 60 and the base of the transistor $Tr_3$ are connected to an output terminal CCW of the microcomputer 51, and the output of the NOT circuit 60 is connected to the base of the transistor $Tr_2$ through the resistor $R_6$. One end of the resistor $R_7$ is connected to the base of the transistor $Tr_3$, and one end of resistor $R_8$ is connected to the base of the transistor $Tr_4$. The other ends of the resistors $R_7$ and $R_8$ are respectively connected to the emitters of the transistors $Tr_3$ and $Tr_4$, and are also respectively connected to the anodes of the diodes $D_3$ and $D_4$. The connecting point of these ends are connected to the minus terminal of the DC power source and, are in a ground level (0 V). Moreover, the collector of the transistor $Tr_3$ and the cathode of the diode $D_3$ are connected to one of the input terminals of the driving motor 36, and the collector of the transistor $Tr_4$ and the cathode of the diode $D_4$ are connected to the other of the input terminals of the driving motor 36.

In the motor driver circuit 52, when the level of the output terminal CCW of the microcomputer 51 is high (while the level of the output terminal CW is kept low), since the transistors $Tr_2$ and $Tr_3$ are switched on, the driving motor 36 is rotated counterclockwise. On the other hand, when the level of the output terminal CW is high (while the level of the output terminal CCW is kept low), since the transistors $Tr_1$ and $Tr_4$ are switched on, the driving motor 36 is rotated clockwise. With the above arrangement, the rotatable sections 32 located in the respective first and second rotatable cassettes 26, 27 are respectively rotated to be set in the lateral feeding position (for example, A4 feeding position or B5 feeding position) when the level of the output terminal CCW of the microcomputer 51 is high, and are respectively rotated to be set in the longitudinal feeding position (for example, A4R feeding position or B5R feeding position) when the level of the output terminal CW is high.

The document size detection device 54 comprises crosswise-direction detection switches (not shown) secured on the guide 4 of the document placing tray 3*a* and feeding position detection switches 5*a*, 5*b*, and is designed to supply data of 4 bits on the document size to the input terminals $OS_1$ through $OS_4$ of the microcomputer 51.

Operation panel keys 55 comprise the copy button 41, the ten keys 42, the magnification setting keys 46, the cassette changeover key 47 and the cassette rotation keys 48, 49 disposed on the operation panel 40 of the copying machine main body 1.

An operation panel display device 56 comprises the copy number display 43, the magnification display 45, the paper size display lamps $PSL_1$ through $PSL_6$ and the cassette selection display lamps $CSL_1$ through $CSL_6$ disposed on the operation panel 40.

The paper nonexistence detection switch 57 (copy material existence detection means) is designed to detect the nonexistence of copy paper in each of the cassettes, and to be switched on when the nonexistence of copy paper is detected. For example, the nonexistence of copy paper may be detected by using optical means such as photointerrupters comprising a light emitting element and a light receiving element, or other means.

The microcomputer 51 is designed to perform control functions in response to each operation instructed by each of the operation panel keys 55. For example, when the rotation key 48 associated with the first rotatable cassette 26 is operated, if the key operation instructs that the rotatable section 32 in the first rotatable cassette 26 should be rotated from the lateral feeding position to the longitudinal feeding position thereof, the level of the output terminal CW is turned high, while the level of the output terminal CCW is kept low. On the other hand, if it instructs that the cassette should be rotated from the longitudinal feeding position to the lateral feeding position, the level of the output terminal CCW is turned high, while the level of the output terminal CW is kept low. Moreover, when the rotatable section 32 has been shifted to the lateral feeding position, and the lateral position sensor $HP_1$ is switched on, that is, light in the photointerrupter is interrupted, the level of the output terminal CCW becomes low immediately, and thus the driving motor 36 is stopped. Similarly, when the rotatable section 32 has been shifted to the longitudinal feeding position, and the longitudinal position sensor $HP_2$ is switched on, the level of the output terminal CW becomes low immediately, and thus the driving motor 36 is stopped. When both of the levels of the output terminals CW and CCW are low, the driving motor 36 is in a stand-by state. Furthermore, the microcomputer 51 is designed to perform control shown in FIGS. 1(*a*) to 1(*c*), which will be described later.

In accordance with the above arrangement, the following description will discuss the rotational operation of the rotatable section 32 in response to the output level (high level or low level) of the output terminals CW, CCW of the microcomputer 51, at first, referring to the first rotatable cassette 26.

When copy paper of, for example, size A4 is stored in the rotatable section 32 of the first rotatable cassette 26, and the rotatable section 32 is located in the lateral feeding position (A4 feeding position), the lateral position sensor $HP_1$ is "on". At this time, the nut member 37 engaged by the threaded shaft 35 is supposed to be located at the position $P_1$ shown in FIG. 8.

In this case, an operation of the rotation key 48 associated with the first rotatable cassette 26 of the operation panel keys 55 permits the level of the output terminal CW of the microcomputer 51 to become high, and the level of the output terminal CCW to become low. As a result, the transistors $Tr_1$ and $Tr_4$ are switched on, a current flows by way through the plus terminal of the dc ower source (output of +24 V), the transistor $Tr_1$, the driving motor 36, the transistor $Tr_4$ and the minus terminal (ground level) of the dc power source, and consequently the driving motor 36 rotates clockwise (in the direction indicated by C in FIG. 4(*a*)). Therefore, since the threaded shaft 35 rotates clockwise, the nut member 37 is moved from $P_1$ through $P_6$ following a sequence ($P_1$, $P_2$, $P_3$, $P_4$, $P_5$and $P_6$) while the guiding shaft 34 of the rotatable section 32 is moved from $Q_1$ through to $Q_6$, making a reciprocating movement following a sequence ($Q_1$, $Q_2$, $Q_3$, $Q_4$, $Q_5$, and $Q_6$) and rotating within the guiding hole 33*a* in the rotatable section support plate 33. The nut member 37 then reaches the longitudinal position sensor $HP_2$, and the longitudinal position sensor $HP_2$ is switched on. After the sequences, the driving motor 36 is stopped, and thus the rotatable section 32 is located in a predetermined longitudinal feeding position (A4R feeding position).

In this condition, a successive operation of the rotation key 48 permits the level of the output terminal CCW of the microcomputer 51 to become high, and the level of the output terminal CW to become low. As a result, the transistors $Tr_2$ and $Tr_3$ are switched on, a current flows by way through the plus terminal of the dc power source (output of +24 V), the transistor $Tr_2$, the driving motor 36, the transistor $Tr_3$ and the minus terminal (ground level) of the dc power source, and consequently the driving motor 36 rotates counterclockwise. Thus, the rotatable section 32 is shifted from the longitudinal feeding position to the lateral feeding position after having a reverse process to the preceding operation. The motor 36 is then stopped when the lateral position sensor $HP_1$ is switched on, and the rotatable section 32 is located in the lateral feeding position.

Figure 1A:
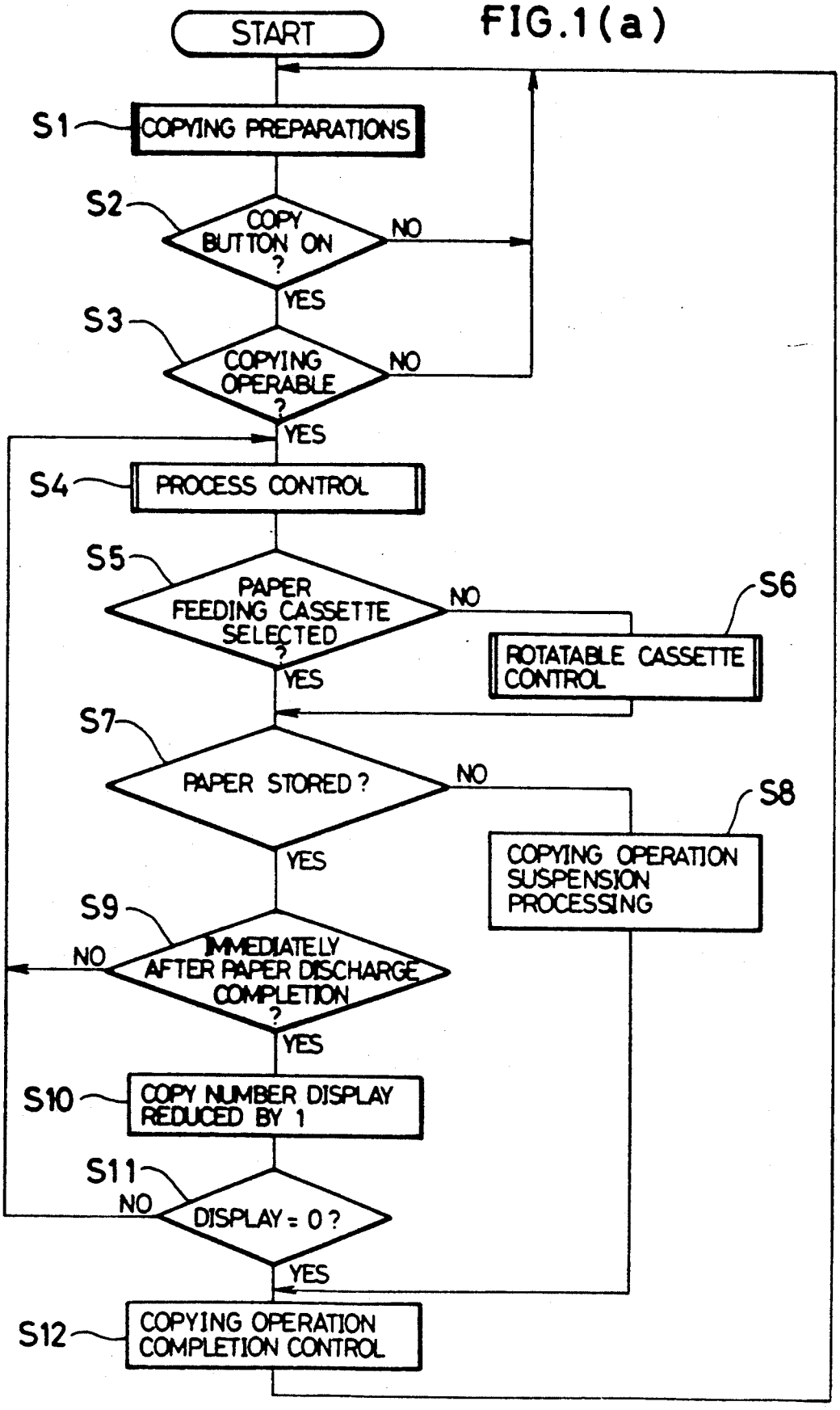
FIGS. 1 through 8 show one embodiment of the present invention.
Figure 1:
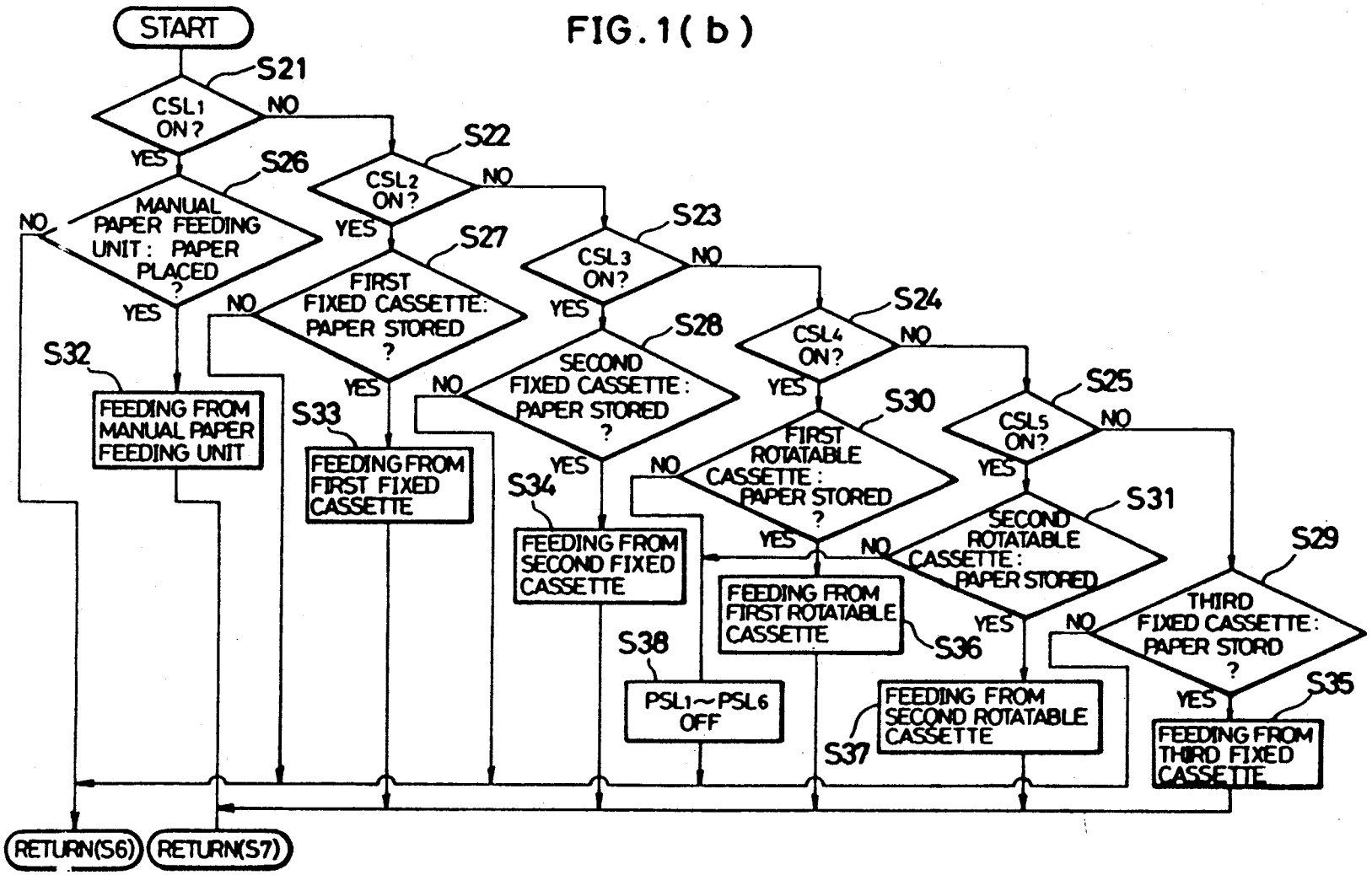
Figure 1C:
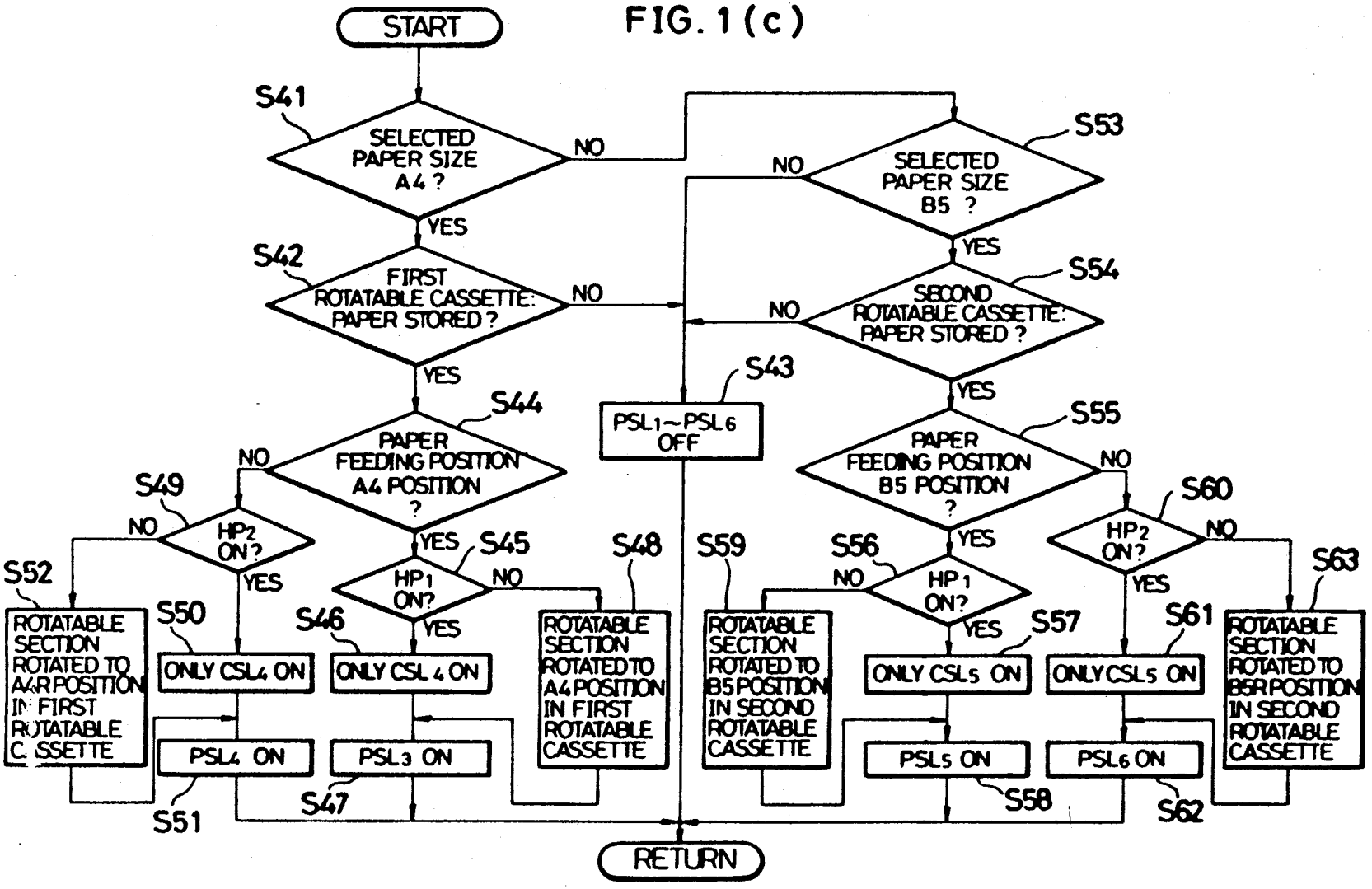

The following description will discuss a main routine with respect to operation of the copying machine referring to a flow chart shown in FIG. 1(*a*).

At first, when the power switch of the copying machine is turned on, preparations for a copying operation such as temperature setting for the fixing device 18 or other preparations are Performed (S1). During S1, the operator selects a cassette for the feeding operation and performs setting of copying magnification or other preparations, and when the copy button 41 is depressed after entering these copying setting conditions (S2), it is judged whether or not the copying machine is in an operable condition (S3). If the copy button 41 is not depressed at S2, the sequence returns to S1. Moreover, if the copying machine is not in an operable condition at S3, the sequence also returns to S1. The processes S1 to S3 are referred to as a stand-by loop from turning on of the power switch to starting of a copying operation.

When the copying machine is in an operable condition at S3, the sequence proceeds to S4 and process control is executed. More specifically, at S4, the process control is performed with respect to means for turning the driving motor to start the copying operation, for scanning by the use of the optical system 6, for charging, exposing and developing to the photosensitive drum 7 and for other processes. When the preparations for copying have been completed at S4, it is judged at S5 whether there is any copy paper in the selected cassette or not, and whether a cassette for the next feeding operation is determined or not. At S5, if there is no copy paper in the selected cassette, or if the copy paper has been consumed during the copying operation, control of the rotatable section 32 selected as the cassette for the next feeding operation in one of the first and second rotatable cassettes 26, 27 is performed (S6).

Moreover, after the cassettes for the feeding operation have been determined at S5, the existence or nonexistence of copy paper in the selected cassettes is being judged even during the copying operation according to the detecting operation for the existence or nonexistence of copy paper by the paper nonexistence detection switch 57 (S7). At this time, if there is no predetermined copy paper either in the selected fixed cassette or in the rotatable section 32 for the next feeding operation, all the paper size display lamps $PSL_1$ through $PSL_6$ are kept "off". If the nonexistence of copy paper is detected at S7, the sequence proceeds to S8, where a copying operation suspension processing is performed, and then proceeds to S12.

On the other hand, when the existence of copy paper is detected at S7, immediately after the completion of discharging the copy paper out of the copying machine S9), more specifically, every time the copy paper is discharged from the copying machine, the count number of copy paper displayed on the copy number display 43 of the operation panel 40 is reduced by one (S10), and then the sequence proceeds to S11. In the case of a duplex copying operation or a composite copying operation (in these cases, the reduction of count number is not necessary at (S10), at S9 the sequence returns to S4, where the sequence of control is started again.

Then, it is judged whether or not multiple copying for making not less than one copy to one document have been finished (S11), and if it has not, the sequence returns to S4. Furthermore, when the multiple copying operations have been finished and the display of the copy number display 43 is turned to "0", a predetermined copying operation completion control is performed (S12), and the sequence returns to S1. In addition, at S8, special processing due to suspension of the copying operation is performed, and the primary copying operation completion control is executed at S12.

Next, referring to FIG. 1(*b*), the following description will discuss a subroutine of S5 in FIG. 1(*a*).

When the cassette changeover key 47 of the operation panel 40 is depressed and a desired cassette is selected, the microcomputer 51 permits one of the cassette selection display lamps $CSL_1$ through $CSL_6$ corresponding to the selected cassette to turn on, and then judges which one of the cassette selection display lamps $CSL_1$ through $CSL_5$ is lighted (S21 through S25). In this case, when neither of the cassette selection display lamps $CSL_1$ through $CSL_5$ is lighted, it is judged that the third fixed cassette 25 corresponding to the cassette selection display lamp $CSL_6$ is selected.

Hereupon, for example, when any one of the manual paper feeding unit 30, the first fixed cassette 29, the second fixed cassette 28 and the third fixed cassette 25 is selected, and the fixed cassette has some copy paper stored therein (S26 to S29), a paper feeding operation from the selected fixed cassette is performed (S32 to S35), and the sequence returns to S7 of the main routine. In addition, the existence or nonexistence of copy paper in each cassette is detected by "on" or "off" of the paper nonexistence detection switch 57. Furthermore, if the selected fixed cassette has no copy paper stored therein at S26 to S29, the sequence returns to S6 of the main routine in order to judge whether or not it is needed to rotate either of the rotatable sections 32 in the first or second rotatable cassette 26, 27.

On the other hand, either of the rotatable sections 32 in the first or second rotatable cassette 26, 27 is selected (S24, S25), and when the rotatable section 32 has some copy paper stored therein (S30, S31 , a paper feeding operation by the selected rotatable section 32 is performed (S36, S37), and the sequence returns to S7 of the main routine. When neither of rotatable sections 32 has any copy paper stored therein, all the paper size display lamps $PSL_2$ through $PSL_6$ are turned off, and the sequence returns to S7 of the main routine, and then immediately enters the copying operation suspension processing at S8.

Next, referring to FIG. 1(*c*), the following description will discuss a subroutine of S6 in FIG. 1(*a*).

The subroutine is arranged to control the rotation of each rotatable section 32 in the first and second rotatable cassettes 26, 27, and the program is executed when there is no copy paper or the copy paper has been consumed in the cassette selected for the current feed. For convenience of explanation, it is supposed that copy paper of size A4 is stored in the rotatable section 32 of the first rotatable cassette 26, and that copy paper of size B5 is stored in the rotatable section 32 of the second rotatable cassette 27.

At first, it is judged whether the size of copy paper selected for the current feed is A4 or B5 (S41), and in the case where copy paper of size A4 has been selected, it is judged whether or not the rotatable section 32 of the first rotatable cassette 26 has some copy paper stored therein (S42). When the cassette has no copy paper stored therein, it is not necessary to rotate the rotatable section 32, and since the cassette selected for the current feed has no copy paper therein, all the paper size display lamps $PSL_1$ through $PSL_6$ are turned off (S43), and the sequence returns to S8 of the main routine, thereby entering the copying operation suspension processing.

At S42, when the rotatable section 32 of the first rotatable cassette 26 has some copy paper therein, it is judged whether the feeding position of the copy paper selected for the current feed corresponds to an A4 feeding position or not (S44), and if it corresponds to the A4 feeding position, it is judged whether or not the lateral position sensor $HP_1$ is "on" (S45). When the lateral position sensor $HP_1$ is "on", only the cassette selection display lamp $CSL_4$ corresponding to the rotatable section 32 of the first rotatable cassette 26 is turned on while the other cassette selection display lamps $CSL_1$ through $CSL_3$, $CSL_5$ and $CSL_6$ are turned off (S46), and after having turned on the paper size display lamp $PSL_3$ (S47), the sequence returns to the main routine.

At S45, when the lateral position sensor $HP_1$ is not "on", the rotatable section 32 is rotated until the lateral position sensor $HP_1$ is switched on, more specifically, the rotatable section 32 is rotated to be set in the A4 feeding position (S48), and the sequence proceeds to S47. In this case, in the next process of S7 shown in FIG. 1(*b*), a feeding operation by the rotatable section 32 of the first rotatable cassette 26 is automatically executed, and therefore the copying operation is continued. In addition, in the middle of the copying operation, if the copy paper in the rotatable section 32 has been consumed, all the paper size display lamps $PSL_1$ through $PSL_6$ are turned off at S30 and at S38 shown in FIG. 1(*b*), thereby suspending the copying operation.

At S44, if the feeding position of the copy paper selected for the current feed corresponds not to A4 but to A4R, it is judged whether or not the longitudinal position sensor $HP_2$ is "on" (S49). When the longitudinal position sensor $HP_2$ is "on", only the cassette selection display lamp $CSL_4$ is turned on (S50), and after having turned on the paper size display lamp $PSL_4$ (S51), the sequence returns to the main routine. On the other hand, when the longitudinal position sensor $HP_2$ is not "on" at S49, the rotatable section 32 is rotated to be set in the A4R feeding position (S52), and the sequence proceeds to S51.

At S41, if the size of the copy paper selected for the current feed is not A4, it is judged whether or not the size of the copy paper selected for the current feed is B5 (S53), and if neither of the sizes of copy paper is selected, all the paper size display lamps $PSL_1$ to $PSL_6$ are turned off (S43), and the sequence returns to S8 of the main routine, thereby entering the copying operation suspension processing.

At S53, when the size of the copy paper selected for the current feed is B5, it is judged whether or not the rotatable section 32 of the second rotatable cassette 27 has some copy paper therein (S54). When it has some copy paper therein, it is judged whether or not the feeding position of the copy paper selected for the current feed is B5 feeding position (S55), and if it corresponds to the B5 feeding position, it is judged whether or not the lateral position sensor $HP_1$ is "on" (S56). Then, if the lateral position sensor $HP_1$ is "on", only the cassette selection display lamp $CSL_5$ corresponding to the rotatable section 32 of the second rotatable cassette 27 is turned on (S57), and after having turned on the paper size display lamp $PSL_5$ (S58), the sequence returns to the main routine. At S56, when the lateral position sensor $HP_1$ is not "on", the rotatable section 32 is rotated until the lateral position sensor $HP_1$ is switched on, more specifically, the rotatable section 32 is rotated to be set in the B5 feeding position (S59), and the sequence proceeds to S58.

At S55, if the feeding position of the copy paper selected for the current feed corresponds not to B5 but to B5R, it is judged whether or not the longitudinal position sensor $HP_2$ is "on" (S60). When the longitudinal position sensor $HP_2$ is "on", only the cassette selection display lamp $CSL_5$ is turned on (S61), and after having turned on the paper size display lamp $PSL_6$ (S62), the sequence returns to the main routine. Moreover, when the longitudinal position sensor $HP_2$ is not "on" at S60, the rotatable section 32 is rotated to be set in the B5R feeding position (S63), and the sequence proceeds to S62.

With the above arrangement, a feeding device of the present invention is designed such that when the copy paper in the cassette selected for the current feed has been consumed, if one of the rotatable sections 32 of the first and second rotatable cassettes 26, 27 has some copy paper of the same size as the copy paper stored in the cassette selected for the current feed, the rotatable section 32 of the first or second rotatable cassette 26, 27 is disposed so as to be set in the same feeding position as the cassette for the current feed, and a successive feeding operation is performed by the use of the rotatable cassette. Moreover, in the case where the rotatable section 32 of the first rotatable cassette 26 selected for the cassette for the current feed, apparently it is possible to perform the next feed operation from the other rotatable section 32 of the second rotatable cassette 27 when the copy paper in the rotatable section 32 previously selected has been consumed.

Figure 9A:
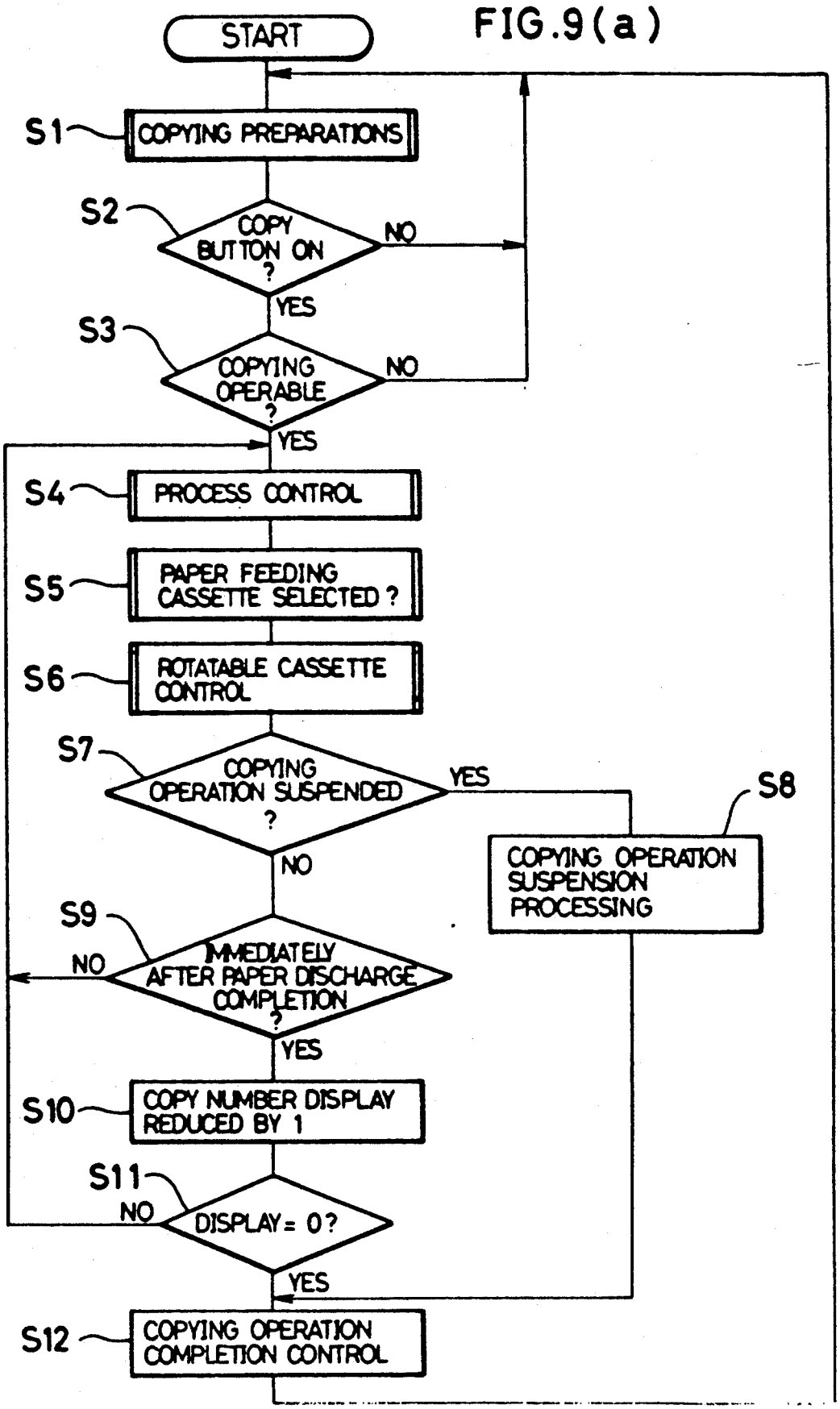
FIGS. 9 through 11 show another embodiment of the present invention.
Figure 9:
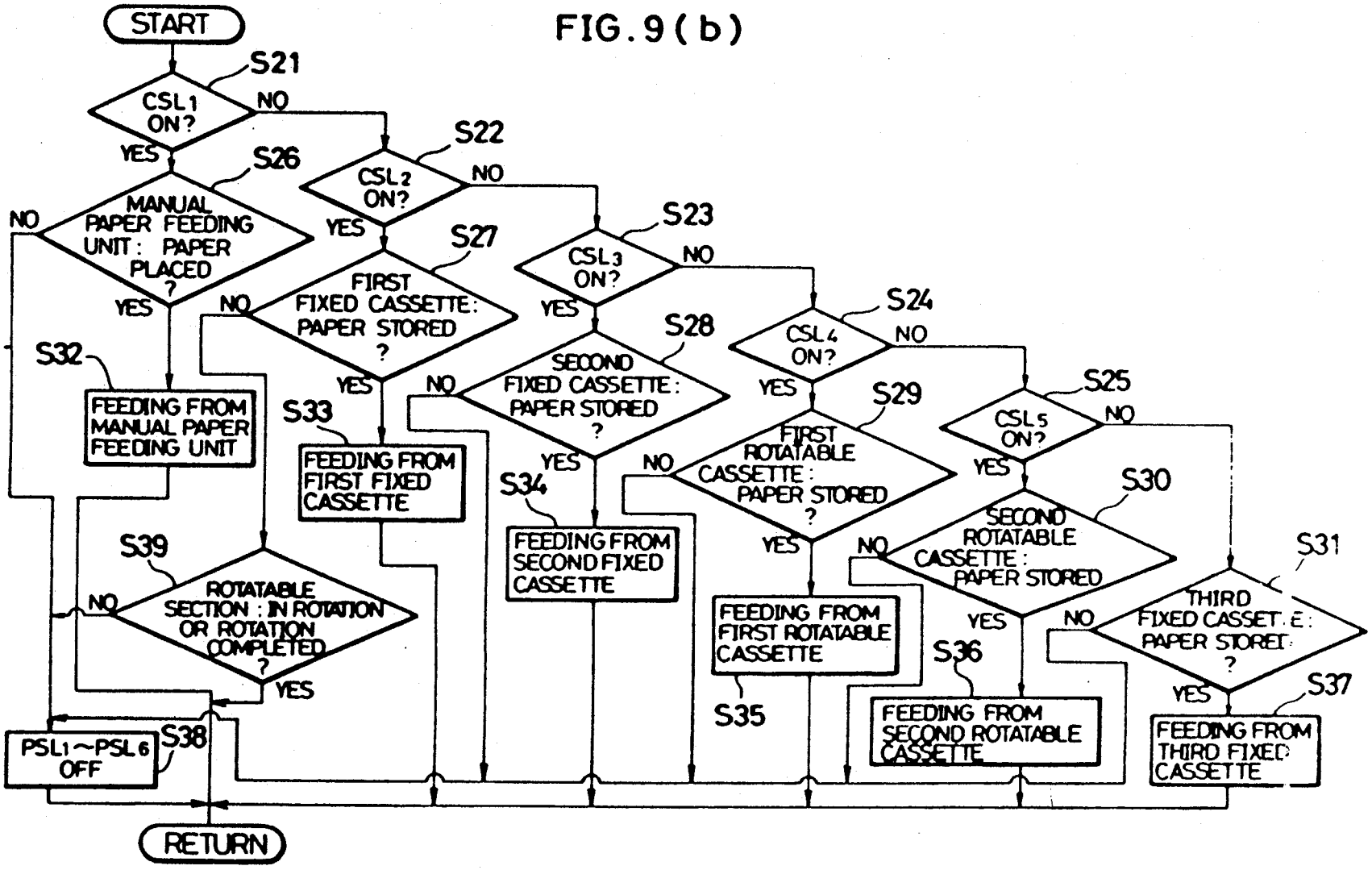
Figure 10:
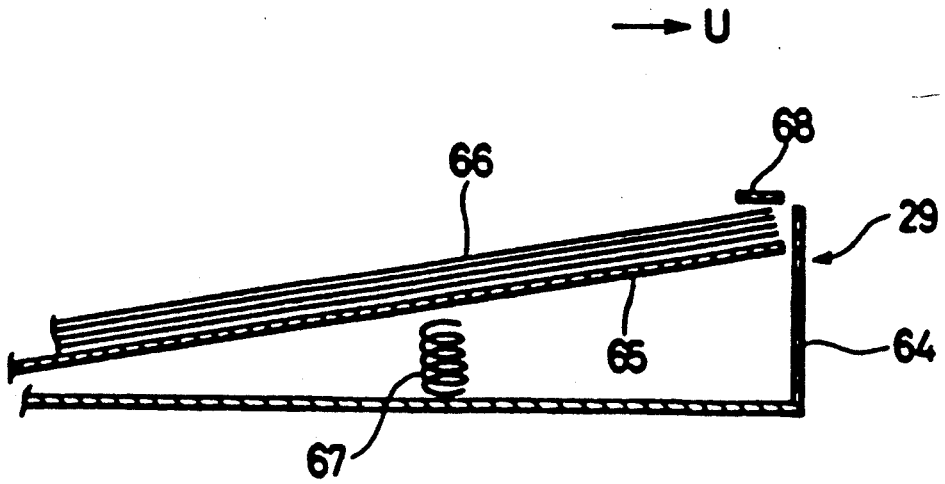
Figure 10:
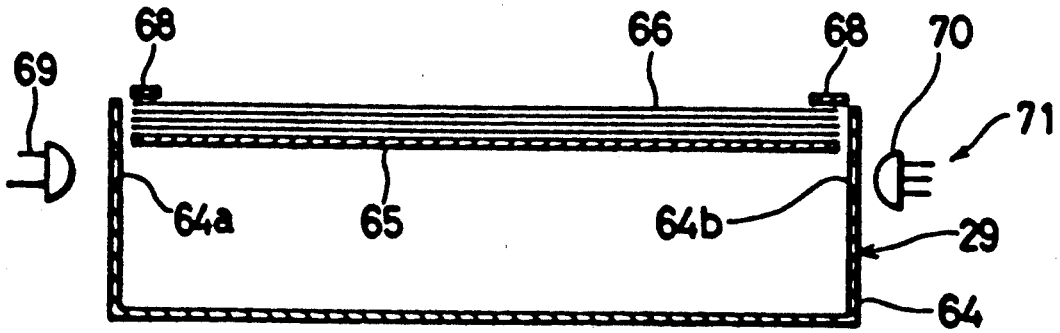
Figure 11:
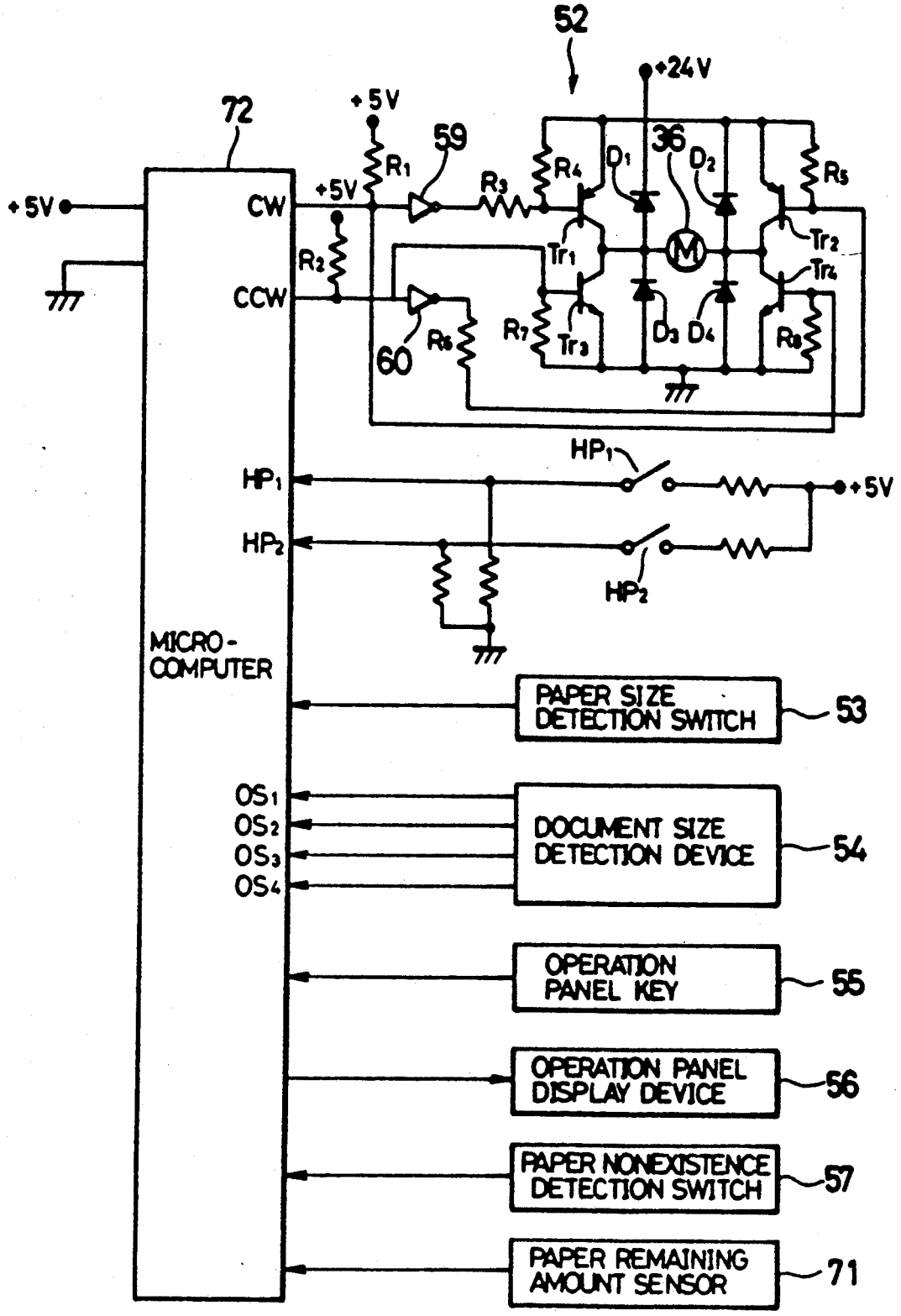

The following description will discuss another embodiment of a feeding device according to the present invention with reference to FIGS. 9 through 11. For convenience of explanation, those of the means having the same functions and described in the first embodiment are indicated by the same reference numerals and the description thereof is omitted.

As shown in FIGS. 10(*a*)(*b*), a first fixed cassette 29 comprises a pivotal paper holding plate 65 on which copy paper 66 is placed, inside a cassette case 64. The pivotal paper holding plate 65 is pivotally supported to the cassette case 64 by an axis fixed at one end thereof which is the opposite side to the paper feeding position shown by U, and is movable upward or downward. The pivotal paper holding plate 65 is given an upward resilience by a spring 67 disposed between the cassette case 64 and the pivotal paper holding plate 65. Moreover, on the copy paper 66 placed on the pivotal paper holding plate 65, are disposed two cassette claws 68. The cassette claws 68 are secured to the cassette case 64. With the arrangement, the pivotal paper holding plate 65 is permitted to rise in response to the reduction of the copy paper 66. In addition, the same arrangement is adopted in all the other cassettes.

On both of the side walls of the cassette case 64, are respectively formed openings 64*a*, 64*b*. In one opening 64*a*, there is disposed a light emitting element 69, and in the other opening 64*b*, there is disposed a light receiving element 70. A paper remaining amount detection sensor 71 (copy material remaining amount detection means) comprises the light emitting element 69 and the light receiving element 70. The paper remaining amount detection sensor 71 is designed to be kept "off" when a remaining amount of the copy paper 66 is not less than a predetermined amount since light emitted from the light emitting element 69 is interrupted by the copy paper 66 and is not able to enter the light receiving element 70, and on the other hand, is designed to be switched on when a remaining amount of the copy paper 66 is less than the predetermined amount since light emitted from the light emitting element 69 is permitted to enter the light receiving element 70.

In the present embodiment, the paper remaining amount detection sensor 71 is installed only in the first fixed cassette 29. Moreover, in order to perform a successive feeding operation, the paper remaining amount detection sensor 71 is designed so as to be switched on when a remaining amount of the copy paper 66 becomes less than a predetermined value, which is enough to be used to perform a successive feeding operation during a period from the actuation of the paper remaining amount detection sensor 71 to the completion of the rotation of the rotatable section 32 of the first or second rotatable cassette 26, 27.

Furthermore, as shown in FIG. 11, to a microcomputer 72 as a control means installed in the present copying machine, is connected the paper remaining amount detection sensor 71 in addition to the same means connected to the aforementioned microcomputer 51. The microcomputer 72 is designed to execute the following control operation shown in FIGS. 9(*a*) through (*c*).

The following description will discuss the control operation of the copying machine by the microcomputer 72 referring to FIGS. 9(*a*) through (*c*).

At first, an explanation is given on an outline of a main routine of the copying machine referring to the flow chart shown in FIG. 9(*a*). In addition, as to S1 to S3 which are referred to as a stand-by loop from the actuation of the power switch to the start of a copying operation, the description thereof is omitted since they are the same as S1 through S3 of FIG. 1(*a*).

When the copying machine is in an operable condition at S3, the sequence proceeds to S4 and process control is executed. Next, preparations for a copying operation are performed at S4, and an operation for determining a cassette for the current feed is executed at S5. At S6, a remaining amount of the copy paper in the cassette during its feeding operation is detected, and if the remaining amount is less than a predetermined value, a control operation for predeterminately rotating one of the rotatable sections 32 in the first or second rotatable cassette 26, 27 is performed. At S7, the existence or nonexistence of copy paper in the selected cassette is being judged even during the copying operation according to the detection for the existence or nonexistence of copy paper by the paper nonexistence detection switch 57. At this time, when the copy paper in the selected cassette for the current feed has been consumed, the sequence proceeds to S8, where copying operation suspension processing is performed, and then proceeds to S12. When the existence of copy paper is detected at S7, immediately after the completion of discharging the copy paper out of the copying machine (S9), more specifically, every time the copy paper is discharged from the copying machine, the count number of copy paper displayed on the copy number display 43 of the operation panel 40 is reduced by one (S10). In the case of a duplex copying operation or a composite copying operation (in these cases, the reduction of count number is not necessary at S10), at S9 the sequence returns to S4, where the sequence of control operation is started again. Then, it is judged whether or not multiple copying operations have been finished (S11), and if they have not, the sequence returns to S4. Furthermore, after the multiple copying operations have been finished, the predetermined copying operation completion control is performed (S12), and the sequence returns to S1.

Next, referring to FIG. 9(*b*), the following description will discuss a subroutine of S5 in FIG. 9(*a*). In addition, for convenience of explanation, in the present embodiment, the first fixed cassette 29 is intended to store copy paper of size A4 or B5, and the paper remaining amount detection sensor 71 is intended to be installed only in the first fixed cassette 29 which stores copy paper generally used most frequently.

When the cassette changeover key 47 of the operation panel 40 is depressed and a desired cassette is selected, the microcomputer 72 permits one of the cassette selection display lamps $CSL_1$ through $CSL_6$ corresponding to the selected cassette to turn on, and then judges which one of the cassette selection display lamps $CSL_1$ through $CSL_5$ is lighted (S21 to S25). When any one of the manual paper feeding unit 30, the first fixed cassette 29, the second fixed cassette 28, the first rotatable cassette 26, the second rotatable cassette 27 and the third fixed cassette 25 is selected, and the cassette for the current feed has some copy paper stored therein (S26 to S31), a paper feeding operation from the selected cassette for the current feed is performed (S32 to S37), and the sequence returns to the main routine, and then proceeds to S9. Moreover, in the case where the selected cassette for the current feed does not have any copy paper at S26, or S28 to S31, all the paper size display lamps $PSL_1$ through $PSL_6$ are turned off (S38), and the sequence returns to the main routine, and then proceeds to S9, where copying operation suspension processing is performed.

On the other hand, in the case where the first fixed cassette 29 does not have any copy paper at S27, it is judged whether the rotatable section 32 of the first or second rotatable cassette 26, 27 is in rotation or has completed the rotation (S39), and when it is in rotation or has completed the rotation, the sequence returns to the main routine so as to continue the copying operation, and then proceeds to S9. In the case where the rotatable section 32 is neither in rotation nor has completed the rotation, since this tells the fact that there is no copy paper in the rotatable section 32, the sequence, after having returned to the main routine via S38, proceeds to S8, where copying operation suspension processing is performed.

Next, referring to FIG. 9(*c*)(1) and FIG. 9(*c*)(2), the following description will discuss a subroutine of S6 in FIG. 9(*a*).

The subroutine is operative only in the case where the cassette which has been selected at S41 is the first fixed cassette 29; therefore the cassette selection display lamp $CSL_2$ is "on", and further the paper remaining amount detection sensor 71 is "on" (which means a copy paper remaining amount is less than a predetermined amount). The subroutine has the first to third routes as follows.

The first route is used for rotating the rotatable section 32 of the first or second rotatable cassette 26, 27 in order to set it in the same feeding position as the cassette for the current feed when the paper remaining amount detection sensor 71 is "on", and the route permits the sequence to proceed from S43 Or S44 to S50.

The second route is used for switching the cassette selection display lamps when the rotation of the rotatable section 32 has been completed, and it has been set in the same feeding position as the cassette for the current feed, and the route permits the sequence to proceed from S43 through S44, S45 to S47.

The third route is used for suspending the copying operation when the rotatable section 32 associated with the cassette for the current feed does not have copy paper or when there are not any rotatable sections 32 associated with the cassette for the current feed, and the route permits the sequence from S43 through S44, S45 to S46.

For convenience of explanation in these routes, the rotatable section 32 of the first rotatable cassette 26 is supposed to store copy paper of size A4, and the rotatable section 32 of the second rotatable cassette 27 is intended to store copy paper of size B5.

In the first route, it is first judged whether or not the cassette selection display lamp $CSL_2$ is "on" (S41), and when it is "on", it is judged whether or not the paper remaining amount detection sensor 71 is "on" (S42). When the cassette selection lamp $CSL_2$ is "off" at S41, and when the paper remaining amount detection sensor 71 is "off" at S42, the sequence returns to the main routine.

At S42, when the paper remaining amount detection sensor 71 is "on", it is judged whether or not the first fixed cassette 29 has some copy paper therein (S43), and if it does not, it is judged whether or not the rotatable section 32 of the first or second rotatable cassette 26, 27 is in rotation (S44). When the first fixed cassette 29 has some copy paper therein at S43, and when either of the rotatable sections 32 is in rotation at S44, the sequence proceeds to S50.

At S50, it is judged whether the size of copy paper selected for the current feed is A4 or B5, and in the case where copy paper of size A4 has been selected, it is judged whether or not the rotatable section 32 of the first rotatable cassette 26 has some copy paper stored therein (S51), and when the cassette has no copy paper stored therein, the sequence returns to the main routine.

When the rotatable section 32 has some copy paper therein, it is judged whether the feeding position of the copy paper selected for the current feed corresponds to A4 feeding position or not (S52), and if it corresponds to A4 feeding position. it is judged whether or not the lateral position sensor $HP_1$ is "on" (S53). Then, when the lateral position sensor $HP_1$ is "on", the rotation of the rotatable section 32 is stopped (S54), the sequence returns to the main routine. In this case, the rotatable section 32 of the first rotatable cassette 26 is located in the lateral feeding position (A4 feeding position).

At S53, when the lateral position sensor $HP_1$ is not "on", the rotatable section 32 is rotated until the lateral position sensor $HP_1$ is switched on, and is disposed in the A4 feeding position (S55), and then the sequence returns to the main routine.

At S52, if the feeding position of the copy paper selected for the current feed corresponds not to the lateral feeding position (A4 feeding position) but to the longitudinal feeding position (A4R feeding position). it is judged whether or not the longitudinal position sensor $HP_2$ is "on" (S56), and when the longitudinal position sensor $HP_2$ is "on", the rotation of the rotatable section 32 is stopped, and the sequence returns to the main routine. In this case the rotatable section 32 of the first rotatable cassette 26 is located in the longitudinal feeding position (A4R feeding position). Moreover, when the longitudinal position sensor $HP_2$ is not "on" at S56, the rotatable section 32 is rotated until the longitudinal position sensor $HP_2$ is switched on, and is set in the A4R feeding position (S58), and the sequence returns to the main routine.

At S50, if the size of the copy paper selected for the current feed is not A4, the sequence proceeds to S59, where it is judged whether or not the size of the copy paper selected for the current feed is B5, and when the size of the copy paper selected for the current feed is B5, it is judged whether or not the rotatable section 32 of the second rotatable cassette 27 has some copy paper therein (S60). Then the processes of S62 to S67 similar to S53 to S58 aforementioned are executed, thereby controlling the rotatable section 32 of the second rotatable cassette 27.

In the above control operation, for example, a remaining amount of the copy paper stored in the first fixed cassette 29 is detected, and before the copy paper is consumed, the rotatable section 32 of the first or second rotatable cassette 26, 27 which stores copy paper of the same size as the first fixed cassette 29 is rotated to be set in the same feeding position as the first fixed cassette 29. Thus a successive feeding operation is performed without having waiting time required for the rotation of the rotatable section 32 when the copy paper stored in the first fixed cassette 29 has been consumed. In addition, during the control operation by the first route, feeding control for multiple copying is executed in the main routine in FIG. 9(*a*) as well as in the subroutine in FIG. 9(*b*).

In the second route, when the copy paper in the first fixed cassette 29 has been consumed at S43, the rotatable section 32 of the first or second rotatable cassette 26, 27 is in a state after having completed its rotation, and the sequence proceeds from S43 through S45 to S47, where it is judged whether the size of the copy paper selected for the current feed is A4 or B5. Then, if copy paper of size A4 is selected, the cassette selection display lamp $CSL_2$ is turned off, and after having turned on the cassette selection display lamp $CSL_4$ (S48), that is, after having switched the cassette 29 to the first rotatable cassette 26, the sequence returns to the main routine. Moreover, if the size of the copy paper which has been selected at S47 is not A4, that is, if the size is B5, the cassette selection display lamp $CSL_2$ is turned off, and after having turned on the cassette selection display lamp $CSL_5$ (S49), that is, after switching the cassette 29 to the second rotatable cassette 27, the sequence returns to the main routine.

As is shown in the above, by switching the display of the cassette selection display lamps showing a selected cassette from $CSL_2$ to $CSL_4$ or $CSL_5$, that is to say, by performing the processing of the subroutine shown in FIG. 9(*b*), without having waiting time required for rotating the rotatable section 32, it is possible to execute a successive feeding operation for copy paper of the same size in the same feeding position.

In the third route, at the time when copy paper in the first fixed cassette 29 has been consumed at S43, the sequence proceeds to S46 through S44 and S45, and after having turned off all the paper size display lamps $PSL_1$ through $PSL_6$, it proceeds to S8, where the copying operation suspension processing is performed.

As is aforementioned, a feeding device according to the present invention comprises: copy material existence detection means for detecting the existence or nonexistence of copy material placed on a copy material feed unit for holding the copy material which is selected to feed the copy material; and control means for controlling copy material orientation changing means which stores copy material of the same size as that placed in the copy material feed unit to be set in the same feeding position thereof as the copy material feed unit when the nonexistence of the copy paper has been detected by the copy material existence detection means. Consequently, even in the case where the copy material in the copy material feed unit for the current feed has been consumed, a successive feeding operation is automatically performed without having such complicated operations as supplying copy material or selecting another copy material feed unit. Accordingly, an efficient operability is obtained, and time required for conveying a given amount of copy paper is shortened.

Besides the above arrangement, another feeding device according to the present invention comprises a copy material remaining amount detection means for detecting a remaining amount of copy material stored in the copy material feed unit selected for the current feed, and when it is detected by the copy material remaining amount detection means that a remaining amount of the copy material is less than a predetermined amount, the control means controls the copy material orientation changing means to be set in the same feeding position thereof as the copy material feed unit. Accordingly, as is aforementioned, an efficient operability is obtained, and even in the case where the copy material in the copy material feed unit for the current feed has been consumed, since the copy material orientation changing means is used for the next feed, time required for conveying a given amount of copy paper is shortened, and therefore a better copying efficiency is achieved. Moreover, the predetermined amount may be preset based on an amount by which the copy material feed unit for the current feed is able to continue its feeding operation until the sifting of the copy material orientation changing means is completed after it has been detected by the copy material remaining amount detection means that a remaining amount of copy material for the current feed contains less than the predetermined amount. This arrangement makes the successive feeding more reliable.

The invention being thus described, it may be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. A feeding device comprising:

at least one copy material orientation changing means which is capable of shifting copy material housed within a corresponding rotatable copy material holding section to at least two feeding positions;

size detection means, provided in connection with said rotatable copy material holding section, for detecting a size of said copy material;

position detection means for detecting a feeding position of said copy material holding section;

a copy material feed unit for holding the copy material which is selected for the current feed;

copy material remaining amount detection means for detecting a remaining amount of copy material in the copy material feed unit selected for the current feed; and control means for controlling said at least one copy material orientation changing means upon detection of a size and position of copy paper within said corresponding rotatable copy material holding section so as to set said corresponding rotatable copy material holding section in the same feeding position for copy material as the copy material feed unit when copy material of the same size as that placed in the copy material feed unit is placed in said corresponding rotatable copy material holding section and it has been detected by said copy material remaining amount detection means that a remaining amount of the copy material is less than a predetermined amount.

2. A feeding device as set forth in claim 1, further comprising driving means for shifting said copy material holding section in response to output from said position detection means.

3. A feeding device as set forth in claim 1, wherein said position detection means comprises photointerrupters each of which includes a light emitting element and a light receiving element.

4. A feeding device as set forth in claim 2, wherein said driving means is a motor rotatable either clockwise or counterclockwise.

5. A feeding device comprising:

at least one copy material holding section for the current feed of copy paper;

at least one rotatable copy material holding section capable of rotating to shift itself either in a longitudinal feeding position form which a copy material is fed longitudinally or in a lateral feeding position from which copy material is fed laterally;

position detection means for detecting the longitudinal feeding position and the lateral feeding position in which said rotatable copy material holding section is set;

means for detecting a size of copy material housed within said rotatable copy material holding section;

driving means for rotating said rotatable copy material holding section:

copy material remaining amount detection means for detecting a remaining amount of copy material placed in the copy material holding section for the current feed; and control means for storing data of the size of the copy material placed in said rotatable copy material holding section and data of the size of the copy material placed in the copy material holding section for the current feed and its longitudinal or lateral feeding position, and for controlling the rotation of said rotatable copy material holding section by said driving means so as to set said rotatable copy material holding section in the same longitudinal or lateral feeding position for copy material as the copy material holding section for the current feed when copy material of the same size as that placed in the copy material holding section for the current feed is placed in the rotatable copy material holding section, and when it is detected by said copy material remaining amount detection means that a remaining amount of the copy material placed in the copy material holding section for the current feed is less than a predetermined amount.

6. A feeding device as set forth in claim 5, wherein the predetermined amount of the copy material is determined based on an amount by which the copy material holding section for the current feed is able to continue its feeding operation until the rotation of said rotatable copy material holding section is completed after it has been detected by said copying amount detection means that a remaining amount of the copy material is less than the predetermined amount.

7. A feeding device as set forth in claims 5 or 6, wherein the copy material holding section for the current feed is a fixed copy material holding section whose feeding position is fixed in a predetermined position.

8. A feeding device as set forth in claims 5 or 6, wherein the copy material holding section for the current feed is a rotatable copy material holding section.

9. A feeding device as set forth in claim 5, wherein said copy material holding section comprises a guiding member secured protruding downward in the center of the backside thereof, is capable of substantially making a 90-degree turn pivoting on the guiding member, and is placed in a housing member which is removably attached to the main body of the device.

10. A feeding device as set forth in claims 5 or 6, wherein the copy material holding section for the current feed is a fixed copy material holding section which is removably attached to the main body of the device.

11. A feeding device as set forth in claim 5, wherein the copy material is sheets of paper for use in copying machines or laser printers.

12. A feeding device as set forth in claim 5, wherein the copy material is sheets of film for use in overhead projectors.

13. The feeding device as set forth in claim 9, wherein the housing member comprises a supporting member by which said rotatable copy material holding section maintains a space between the bottom wall thereof and that of the housing member.

14. A feeding device as set forth in claim 13, wherein said driving means is a motor having a shaft rotatable either clockwise or counterclockwise.

15. A feeding device as set forth in claim 14, wherein the supporting member has a guiding hole having an elongated shape in the center part thereof, which permits the guiding member to make rotational reciprocating movements therein.

16. A feeding device as set forth in claim 15, wherein a threaded shaft is connected to the shaft of the motor, and the threaded shaft is engaged by a nut member which makes reciprocating movements along the threaded shaft according to the rotation of the threaded shaft.

17. A feeding device as set forth in claim 16, wherein the upper end of the nut member is rotatably connected to one corner of the rotatable section, and the nut member comprises a light interrupting member formed at the lower end thereof.

18. A feeding device as set forth in claim 5, wherein said position detection means are photointerrupters each of which includes a light emitting element and a light receiving element.

19. A feeding device as set forth in claim 5, wherein the copy material holding section for the current feed comprises depressible projecting members each of which is respectively located in a position indicating the size of copy material placed int the copy material holding section, and the size of copy material is identified by the actuation of the projecting member when the copy material holding section for the current feed is attached to the main body of the device.

20. A feeding device as set forth in claim 5, wherein said copy material remaining amount detection means comprises a light emitting element and a light receiving element.

21. A feeding device as set forth in claim 5, wherein the copy material holding section for the current feed is a fixed copy material holding section having a predetermined feeding position, and comprises a pivotal paper holding plate therein on which the copy material is placed, and the pivotal paper holding plate is pivotally supported to the fixed copy material holding section by an axis at one end thereof at the opposite side to the feeding side of the copy material so as to be movable either upward or downward, and is given upward resilience by a spring.

22. A feeding device as set forth in claim 21, further comprising two copy material holding section claws secured to the fixed copy material holding section so as to be disposed on the copy material on the pivotal paper holding plate, which permits the pivotal copy material holding plate to rise in response to the reduction of the copy material.

23. A feeding device as set forth in claim 22, wherein said copy material remaining amount detection means comprises a light emitting element and a light receiving element respectively disposed on both sides of the fixed copy material holding section so as to be located at predetermined positions for measuring a predetermined amount by which the feeding operation of the copy material is successively performed.

24. A feeding method comprising the steps of:

selecting a paper feeding copy material holding section and feeding copy paper;

detecting the remaining amount of the copy paper stored in the selected paper feeding copy material holding section; and rotating a rotatable section of a rotatable copy material holding section storing copy paper of the same size as that in the paper feeding copy material holding section prior to use thereof in the case where it is detected that a remaining amount of the copy paper stored in the selected paper feeding copy material holding section is less than a predetermined amount; and continuing the paper feeding operation by the use of the rotatable copy material holding section when there is no copy paper in the paper feeding copy material holding section.

25. A method as set forth in claim 24, wherein the predetermined amount is determined by a copy material remaining amount detection means including a light emitting element and a light receiving element respectively disposed on both sides of the selected paper feeding copy material holding section so as to be located at predetermined positions for measuring a predetermined amount by which the feeding operation of the copy material is successively performed.

* * * * *